US007708602B2

(12) United States Patent
Rascon et al.

(10) Patent No.: US 7,708,602 B2
(45) Date of Patent: May 4, 2010

(54) CONNECTOR KEEP-OUT APPARATUS AND METHODS

(75) Inventors: Thomas Rascon, Temecula, CA (US); Christopher P. Schaffer, Fallbrook, CA (US); Gary L. Hurd, San Diego, CA (US)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 12/074,131

(22) Filed: Feb. 28, 2008

(65) Prior Publication Data

US 2008/0220657 A1 Sep. 11, 2008

Related U.S. Application Data

(60) Provisional application No. 60/904,464, filed on Mar. 1, 2007.

(51) Int. Cl.
*H01R 24/00* (2006.01)

(52) U.S. Cl. ..... 439/676; 439/137

(58) Field of Classification Search ..... 439/136, 439/137, 676, 677, 680
See application file for complete search history.

(56) References Cited

U.S. PATENT DOCUMENTS 5,069,641 A 12/1991 Sakamoto et al.
5,105,981 A 4/1992 Gehman
5,587,884 A 12/1996 Raman
5,624,274 A 4/1997 Lin
5,736,910 A 4/1998 Townsend et al.
5,755,821 A 5/1998 Ngai et al.
5,971,805 A 10/1999 Belopolsky et al.
6,062,908 A 5/2000 Jones
6,086,430 A 7/2000 Amoni et al.
6,116,963 A 9/2000 Shutter
6,159,039 A 12/2000 Wu
6,159,050 A 12/2000 Belopolsky et al.
6,176,741 B1 1/2001 Shutter
6,186,835 B1 2/2001 Cheshire
6,193,560 B1 2/2001 Morana et al.
6,224,425 B1 5/2001 Shutter
6,257,935 B1 7/2001 Zhang et al.
6,296,528 B1 10/2001 Roberts et al.
6,302,741 B1 10/2001 Fasold et al.
6,312,293 B1 11/2001 Wang
6,325,664 B1 12/2001 Someda et al.
6,350,156 B1 2/2002 Hasircoglu et al.
6,368,154 B1 * 4/2002 Hirata et al. ..... 439/609
6,409,548 B1 6/2002 Gutierrez
6,458,001 B1 10/2002 Chen
6,471,551 B2 10/2002 Morana et al.
6,585,540 B2 7/2003 Gutierrez et al.

(Continued)

*Primary Examiner*—Ross N Gushi
(74) *Attorney, Agent, or Firm*—Gazdzinski & Associates, PC

(57) ABSTRACT

Connector apparatus and methods providing for "keep-out" functionality against improperly sized plugs or inserts are disclosed. In one embodiment the invention discloses a connector assembly incorporating an integrated keep-out feature associated with the housing. In one variant, the connector assembly comprises a modular jack connector, and the keep-out feature(s) is/are formed substantially within one or more the sidewall(s) of the housing, thereby simplifying its assembly and reducing its cost, as well as conserving on connector interior space. In another embodiment, the keep-out feature comprises an element disposed substantially within a plane parallel to the front face of the connector. Methods for manufacturing and using connectors with integrated keep-out features are also disclosed.

11 Claims, 18 Drawing Sheets

U.S. PATENT DOCUMENTS 6,642,827 B1 11/2003 McWilliams
6,769,936 B2 8/2004 Gutierrez et al.
6,773,298 B2 8/2004 Gutierrez et al.
6,773,302 B2 8/2004 Gutierrez et al.
6,808,427 B1 10/2004 Xue
6,857,910 B2 * 2/2005 Lin ..... 439/676
6,881,096 B2 4/2005 Brown
6,962,511 B2 11/2005 Gutierrez et al.
6,987,852 B2 1/2006 Kameya et al.
7,086,879 B2 8/2006 Higham et al.
7,241,181 B2 7/2007 Machado
7,264,489 B2 9/2007 Higham et al.
7,314,392 B2 1/2008 Pharn et al.
7,347,628 B2 3/2008 Graham et al.
2003/0157843 A1 8/2003 Thomas
2004/0132345 A1 7/2004 Lin
2004/0224565 A1 11/2004 Wan et al.
2004/0235358 A1 11/2004 Wan et al.
2005/0070168 A1 * 3/2005 Xue ..... 439/676
2005/0266732 A1 12/2005 Karir

* cited by examiner

CONNECTOR KEEP-OUT APPARATUS AND METHODS

PRIORITY

This application claims priority to U.S. Provisional Patent Application Ser. No. 60/904,464 filed Mar. 1, 2007 of the same title, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The present invention relates generally to electrical or electronic components and particularly in one exemplary aspect to apparatus and methods to prevent insertion of improper modular type plugs into corresponding jacks.

2. Description of Related Technology

Modular jack connectors, such as for example those of the "RJ" configuration, are well known in the electronics industry. Such modular jack connectors are adapted to receive one or more modular plugs of varying type (e.g., RJ-45 or RJ-11), and communicate signals between the terminals of the modular plug and the parent device with which the modular jack connector is associated. Commonly, some form of signal conditioning (e.g., filtering, voltage transformation, or the like) is performed by the connector on the signals passing through it or by electronic components adjacent to the connector.

In telecommunications data and voice applications, there are modular jacks and plugs which contain differing numbers of poles or contacts (e.g. 4, 6, 8, etc.). Typically, the pitch between the terminals are the same for a plurality of different connector types so that, for example, a six-pole type modular plug can be plugged by mistake into an eight-pole type modular jack, which can cause electrical and/or mechanical malfunction.

This problem has been addressed in a myriad of prior art solutions, including for example U.S. Pat. No. 5,755,821 to Ngai, et al. issued May 26, 1998 and entitled "Device for preventing the erroneous connection of signal lines to a computer network hub" discloses either of a pair of adjacent plug holes in a computer network hub that is automatically closed by a swinging door plate whenever a connector of a signal line is inserted into the other plug hole to prevent the simultaneous insertion of two connectors into both plug holes.

U.S. Pat. No. 6,186,835 to Cheshire issued Feb. 13, 2001 and entitled "Socket connector having a flexible internal barrier to prevent incorrect insertion of smaller sized plugs" that discloses a socket connector that has flexible interior barriers to prevent incorrect insertion of smaller sized plugs, where a flexible internal barrier is formed on a side of the socket entry leading into the socket cavity, and is composed of a flexible ramp attached from the socket entry, the ramp extending into the socket cavity and having a inner movable end with a vertical barrier, sized and disposed within the socket cavity so that the insertion of a correctly sized wide plug will engage the flexible ramp, riding along and moving the flexible ramp so that the vertical barrier is moved out of a stopping position, allowing the correctly sized wide plug to be fully and properly seated in the cavity, but further sized and disposed within the socket cavity so that the insertion of an incorrectly sized narrow plug will fail to engage the ramp, will not flex the ramp, and will leave the vertical barrier in the stopping position, where it prevents the incorrectly sized narrow plug from being fully inserted into the socket cavity. The improved socket can be an RJ45 network socket, the correctly sized wide plug can be an RJ45 network plug, and the incorrectly sized narrow plug can be an RJ11 telephone plug.

U.S. Pat. No. 6,296,528 to Roberts, et al. issued Oct. 2, 2001 and entitled "Jack with feature for selectively restricting plug insertion" discloses a modular jack that includes a rectangular dielectric receptacle housing having a front face, a bottom board mounting wall, and a top, rear and a pair of side walls substantially surrounding a plug-receiving cavity. The cavity extends rearwardly from the front face for receiving a mating plug connector. In order to limit insertion of an undersized plug into a full-sized plug-receiving cavity in the receptacle housing, a stop surface is incorporated into a flexible stop member projecting from the housing and extending into the plug-receiving cavity. The stop surface is located within the cavity so as to ensure contact with a leading edge of an undersized plug upon insertion of the undersized plug into the cavity. A sliding surface is also incorporated into the flexible member. The sliding surface is located within the cavity so as to ensure contact with a leading edge of a plug upon insertion into the cavity of a mating plug having a width appropriate for mating with the jack. The sliding surface resides closer to the front face of the receptacle housing than does the stop surface. When an undersized plug is inserted into the cavity, the leading edge of the undersized plug contacts the stop surface, preventing full insertion of the undersized plug into the cavity. When a mating plug is inserted into the cavity, the leading edge of the mating plug contacts the more forwardly-positioned sliding surface before reaching the stop surface. Sliding contact between the sliding surface and the mating plug leading edge causes the sliding surface to move. This movement produces a corresponding movement in the flexible stop member and the stop surface incorporated thereon such that the stop surface is located out of engagement with the leading surface of the mating plug, permitting full insertion of the mating plug into the cavity.

U.S. Pat. No. 6,350,156 to Hasircoglu, et al. issued Feb. 26, 2002 and entitled "Modular jack with deflectable plug-blocking member" discloses a modular jack for receiving an RJ-45 plug and for blocking insertion of an RJ-11 plug. The modular jack has stamped and formed deflection members having retention sections, ramp surfaces and blocking tabs extending from ends of the ramp surfaces. The blocking tabs project laterally inwardly toward the plug-receiving cavity and block an RJ-11 plug from being inserted into the modular jack. An RJ-45 plug is wider than the RJ-11 plug and engages the ramp surfaces of the deflection members to deflect the blocking tabs away from the plug-receiving cavity, thereby allowing insertion of the RJ-45 plug.

U.S. Pat. No. 6,987,852 to Kameya, et al. which discloses a modular jack that comprises a housing and a mechanism consisting of a pair of spring members cantilevered to the housing. The modular jack further comprises an abutment section provided at the front end of each spring member. Each abutment section consists of a cam portion having an inclined face and a stopper portion provided behind and inside the cam portion. When a modular plug having a predetermined number of poles is inserted into the modular jack, the front ends of the modular plug abut the inclined faces of the cam portions to move the abutment sections outwardly, permitting insertion of the modular plug. When a modular plug having a number of poles that is smaller than the predetermined number is inserted, the front ends of the modular plug abut against the stopper portions to block insertion of the modular plug. Numerous other solutions of varying design exist.

U.S. Pat. No. 7,086,879 to Higham, et al. issued Aug. 8, 2006 and entitled "Dual connector assembly with sliding keep-out member" discloses a connector assembly that includes first and second sockets disposed on opposite sides of a housing and defining first and second insertion paths, respectively, for receiving a plug. A sliding keep-out member has first and second blocking surfaces. The keep-out member can move back and forth through the housing between first and second positions. In the first position, the first blocking surface blocks at least a portion of the first insertion path, but the second blocking surface clears the second insertion path. In the second position, the second blocking surface blocks at least a portion of the second insertion path, but the first blocking surface clears the first insertion path. Thus the connector assembly may receive plugs in either the first or the second socket, but not in both sockets simultaneously.

U.S. Pat. No. 7,264,489 to Higham, et al. issued Sep. 4, 2007 and entitled "Dual connector assembly with pivoting keep-out member" discloses a connector assembly for an electronic device that saves space and cost. It includes first and second sockets defining first and second insertion paths for receiving mating plugs. A pivoting keep-out member has first and second blocking surfaces and can be pivoted between first and second positions. In the first position, the first blocking member blocks at least a portion of the first insertion path, but the second blocking member clears the second insertion path. In the second position, the second blocking member blocks at least a portion of the second insertion path, but the first blocking member clears the first insertion path. Thus the connector assembly may receive a plug in either the first or the second socket, but not in both simultaneously.

United States Patent Publication No. 20030157843 to Thomas published Aug. 21, 2003 and entitled "Stacking connector with improper plug type prevention" discloses a stacked connector for use on a printed circuit board of a computer, for conserving connection space by providing two or more connector sockets, preferably oriented one atop the other. One or more of the connector sockets may be configured to prevent the insertion of an improper plug type having a similar form factor which is capable of being inserted into one of the sockets.

However, these prior art configurations, while effective for their designed task, are not optimized in terms of inter alia, cost and manufacturing simplicity. Accordingly, it would be desirable to provide an improved electrical connector design that would yield a simple and reliable connector that facilitates economical fabrication. Such a connector design would ideally allow for the use of anything ranging from no internal electronic components to a variety of different electronic signal conditioning components in the connector signal path (s), as well as status indicators if desired, without affecting connector profile or footprint, or requiring appreciable changes to the housing. The improved connector design would also facilitate easy assembly, as well as removal of the internal components of the device if required. The design would further be amenable to integration into a multi-port connector assembly, including the ability to vary the configuration of the internal components associated with each port of the assembly individually.

SUMMARY OF THE INVENTION

The present invention satisfies the aforementioned needs by an improved modular connector apparatus and method for manufacturing the same.

In a first aspect of the invention, a connector assembly with an integrated keep-out feature is disclosed. In one embodiment, the connector assembly comprises a connector housing; and a keep-out feature integrated substantially within the plane of at least one sidewall of the housing.

In one variant, the connector housing comprises a multi-port connector.

In another variant, the keep-out feature substantially comprises a cantilever beam.

In yet another variant, the cantilever beam comprises a head section, the head section comprising a ramp feature and a stop feature.

In yet another variant, the ramp feature is engaged by an inserted RJ-45 plug, thereby moving the stop feature out of a plug receiving cavity of the connector housing.

In yet another variant, the cantilever beam comprises at least one bend.

In yet another variant, the cantilever beam comprises at least two bends.

In yet another variant, the at least one sidewall comprises a first width, the keep-out feature comprising a cantilever beam width substantially equal to the first width.

In yet another variant, the housing comprises a plug-receiving cavity formed in a front face thereof, and the at least one of the plurality of walls comprises a sidewall. The keep-out features substantially frustrate insertion of an incorrectly-sized modular plug in the cavity.

In yet another variant, the keep-out feature comprises a substantially cantilevered arm being molded as part of said sidewall.

In yet another variant, at least a portion of said substantially cantilevered arm extends into the plane of a top or bottom wall of said connector.

In yet another variant, the substantially cantilevered arm comprises an arcuate portion which causes said arm to change direction along its length by at least forty-five (45) degrees.

In yet another variant, the keep-out feature integrated substantially within the plane of at least one sidewall of the housing comprises first and second cantilevered arms, the first and second arms being disposed at least partly within the planes of first and second sidewalls of the housing, respectively.

In a second aspect of the invention, a connector assembly with a keep out feature is disclosed. In one embodiment, the connector assembly comprises a connector housing; and a keep-out feature disposed substantially within a plane that is substantially parallel with a front face of the housing.

In one variant, at least a portion of the feature is adapted to deflect or rotate within the plane upon actuation by a properly-sized plug.

In another variant, the keep-out feature comprises a deflection feature and a stop feature, wherein the stop feature is deflected out of a plug receiving cavity in the connector housing upon actuation by the properly-sized plug.

In yet another variant, the keep-out feature is integrally molded into the connector housing.

In yet another variant, the keep-out feature comprises a separately formed element.

In yet another variant, the keep-out feature comprises a metallic structure comprising a deflection feature and a stop feature, wherein the stop feature is deflected out of a plug receiving cavity in the connector housing upon actuation by a properly-sized plug.

In another embodiment, the connector assembly comprises a connector housing comprising a plug receiving recess and a keep out feature recess; a conductive shield substantially surrounding the connector housing; and a keep out feature resident substantially within the keep out feature recess.

In one variant, the keep out feature comprises a cantilever beam having a shield contact portion; wherein the keep out feature recess is located at a top surface of the connector housing and is enclosed at the top surface by the shield.

In another variant, the shield in combination with the shield contact portion acts as a fulcrum for the cantilever beam such that when a properly sized plug is inserted into the plug receiving recess, the keep out feature is deflected upward out of the plug receiving recess.

In another embodiment, the connector comprises a single-port modular jack adapted for use on, inter alia, a printed circuit board or other device. The connector assembly comprises a connector housing that further comprises an integrated keep-out feature. In one variant, the keep-out feature comprises two curved elements formed substantially into respective sidewalls of the housing. In another variant, the elements are substantially linear (straight). In still another variant, the element comprises a substantially right-angled member that is disposed in a plane substantially parallel with the front face of the connector housing, and is which is deflected in a rotational aspect within the plane so as to permit insertion of the properly sized plug. The properly sized plug may comprise e.g., an RJ-45 plug, or yet another type.

The aforementioned variants of the element may also optionally be made as a separate component from the housing; e.g., formed separately and then attached to the housing via e.g., frictional insertion or heat-staking, adhesives, etc.

In another embodiment, the connector housing comprises a multi-port connector. In one variant, the multi-port connector comprises a 1×N configuration. In another variant, the multi-port connector comprises a 2×N configuration. In still another variant, the multi-port connector comprises a modular-over-USB device.

In still another embodiment, the connector assembly comprises a housing with at least one slot, and at least one arm member disposed therein. An external noise shield captures at least a portion of the arm member in the slot, and allows it to operate in a substantially resilient fashion when the proper sized plug is inserted into the port of the housing.

In a third aspect of the invention, a method of manufacturing the aforementioned connector apparatus is disclosed. In one embodiment, the method comprises molding a housing of the connector comprising the integrated keep-out feature, the molding forming the feature substantially within at least one sidewall of the housing.

In one variant, the integrated keep-out feature substantially comprises a cantilever beam.

In another variant, the method comprises forming a cantilever beam comprising a head section, the head section comprising a ramp feature and a stop feature.

In yet another variant, the cantilever beam is formed with at least one bend.

In yet another variant, the cantilever beam is formed with at least two bends.

In yet another variant, the at least one sidewall comprises a first width, the keep-out feature comprising a cantilever beam width substantially equal to the first width.

In yet another variant, the method comprises forming the feature substantially within at least one sidewall of the housing that comprises forming a substantially arcuate and cantilevered arm.

In another embodiment, the method comprises injection molding the connector that comprises the integrated keep-out feature.

In yet another embodiment, the method comprises: forming a housing having at least one slot formed in an outer surface thereof; disposing at least one deflection member in said at least one slot; and disposing a shield substantially around at least a portion of said housing, thereby at least partly capturing said deflection member.

In a fourth aspect of the invention, a method of operating a connector is disclosed. In one embodiment, the connector comprises a housing having at least one keep-out feature formed substantially in at least one sidewall, and the method comprises: actuating said at least one feature when a properly sized plug is inserted into a port of said housing, said actuating comprising deflecting at least a portion of said housing.

In a fifth aspect of the invention, an improved keep-out feature is disclosed. In one embodiment, the feature comprises a substantially arcuate element that is formed so as to be substantially integral with a connector housing. In one variant, the element is coupled via at least one end to a sidewall of said housing, thereby conserving interior space in the connector.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Figure 1A:
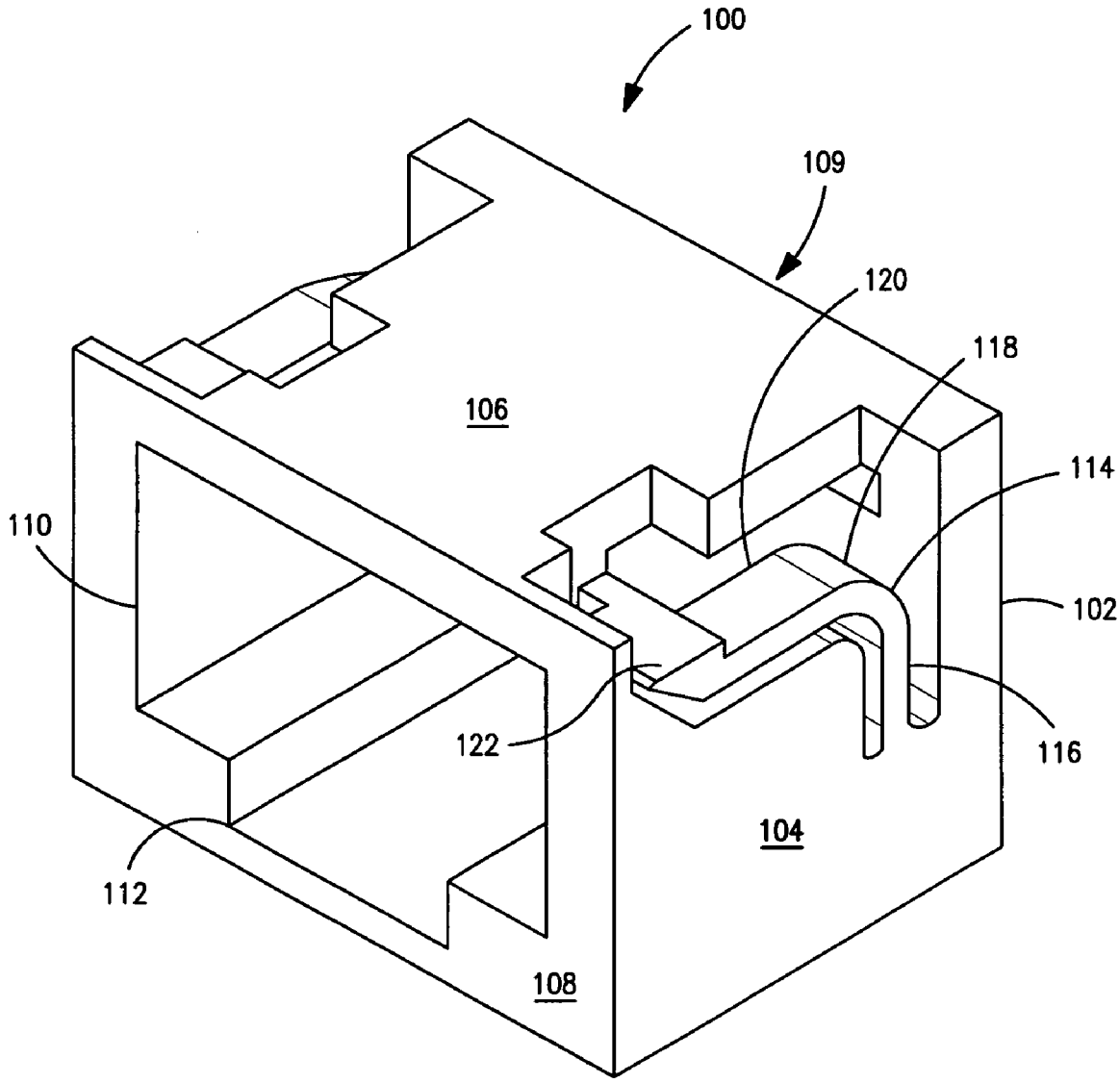
FIG. 1A is a front perspective view of a first embodiment of a modular jack connector incorporating an integrated keep-out feature.

Reference is now made to the drawings wherein like numerals refer to like parts throughout.

As used herein, the term "connector" refers without limitation to any electrical or optical interface or connection apparatus such as for example those shown in U.S. Pat. No. 6,773,302 entitled "Advanced microelectronic connector assembly and method of manufacturing", U.S. Pat. No. 6,773,298 entitled "Connector assembly with light source sub-assemblies and method of manufacturing", U.S. Pat. No. 6,769,936 entitled "Connector with insert assembly and method of manufacturing", U.S. Pat. No. 6,585,540 entitled "Shielded microelectronic connector assembly and method of manufacturing", U.S. Pat. No. 6,471,551 entitled "Connector assembly with side-by-side terminal arrays", U.S. Pat. No. 6,409,548 entitled "Microelectronic connector with open-cavity insert", U.S. Pat. No. 6,325,664 entitled "Shielded microelectronic connector with indicators and method of manufacturing", U.S. Pat. No. 6,224,425 entitled "Simplified microelectronic connector and method of manufacturing", U.S. Pat. No. 6,193,560 entitled "Connector assembly with side-by-side terminal arrays", U.S. Pat. No. 6,176,741 entitled "Modular Microelectronic connector and method for manufacturing same", U.S. Pat. No. 6,159,050 entitled "Modular jack with filter insert", U.S. Pat. No. 6,116,963 entitled "Two-piece microelectronic connector and method", U.S. Pat. No. 6,062,908 entitled "High density connector modules having integral filtering components within repairable, replaceable sub-modules", U.S. Pat. No. 5,587,884 entitled "Electrical connector jack with encapsulated signal conditioning components", U.S. Pat. No. 5,736,910 entitled "Modular jack connector with a flexible laminate capacitor mounted on a circuit board", U.S. Pat. No. 5,971,805 entitled "Modular jack with filter insert", U.S. Pat. No. 5,069,641 entitled "Modular jack", United States Patent Application Publication No. 20030194908 to Brown, et al. published Oct. 16, 2003 entitled "Compact Serial—To Ethernet Conversion Port", and U.S. patent application Ser. No. 11/170,583 filed Jun. 28, 2005 and entitled "Universal Connector Assembly And Method Of Manufacturing," each of the foregoing patents incorporated herein by reference in its entirety.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, transistors and diodes, whether discrete components or integrated circuits, whether alone or in combination. For example, the improved toroidal device disclosed in co-Assignee's co-pending U.S. patent application Ser. No. 09/661,628 entitled "Advanced Electronic Microminiature Coil and Method of Manufacturing" filed Sep. 13, 2000, which is incorporated herein by reference in its entirety, may be used in conjunction with the invention disclosed herein. Furthermore, so-called "interlock base" assemblies such as those manufactured by the Assignee hereof and described in detail in, inter alia, U.S. Pat. No. 5,105,981 entitled "Electronic Microminiature Packaging and Method", issued May 14, 1991, and incorporated by reference herein in its entirety, may be used.

As used herein, the term "signal conditioning" or "conditioning" shall be understood to include, but not be limited to, signal voltage transformation, filtering, current limiting, sampling, processing, splitting, and time delay.

It is noted that while the following description is cast primarily in terms of one or a plurality of RJ-type jacks and associated modular plugs of the type well known in the art, the present invention may be used in conjunction with any number of different connector types. Accordingly, the following discussion of the RJ-type jacks and plugs is merely exemplary of the broader concepts.

Single Port Embodiment

Referring now to FIG. 1A, a first embodiment of a modular jack 100 incorporating integrated keep-out features 114 is shown and described in detail. The modular jack 100 shown in FIG. 1A is intended to be generalized and may readily be incorporated into any number of connectors including modular connector designs. Advantageously, the improved keep-out apparatus of the invention is largely agnostic to the underlying connector or jack architecture.

Referring back to FIG. 1A, the modular jack connector 100 advantageously comprises a housing 102 made of an insulating material such as an injection-moldable polymer material. Injection-moldable polymers are desirable because of their extensive use in the electronics industry and their low cost. The housing 102 of the modular jack connector 100 generally comprises side walls 104, a front wall 108, a rear wall 109, and top and bottom walls 106 and may take on any number of shapes (such as those disclosed in the above U.S. Patents incorporated by reference herein). The port 110 shown in FIG. 1A is a tab 112 down configuration, although it is recognized that a tab-up configuration (i.e. where tab 112 is positioned adjacent to top wall 106) may be readily adapted to the modular jack 100 shown in FIG. 1A given the present disclosure provided herein.

The modular jack connector 100 of the present embodiment incorporates two keep-out features 114 integrated into the housing 102 of the modular jack 100. Each keep-out feature 114 is integrally molded into the side wall 104 of the housing 102 and comprises a first cantilever arm section 116 which projects generally parallel to the plug insertion direction for a portion of its run, and then downward (i.e., transverse to plug insertion) for a second portion of its run. The first cantilever arm section 116 extends from the side wall 104 of the housing 102 via filleted joints which serve to strengthen the interface between the side wall 104 and its respective keep-out feature 114. Radial section 118 of keep-out feature 114 transitions the first cantilever arm section 116 into a second cantilever arm section 120 which runs in a direction generally parallel to the modular plug insertion direction and generally perpendicular to the direction of the first cantilever arm section 116, although these angular relationships need not be observed in all applications. The length of the first and second cantilever sections 116, 120 respectively are governed largely by the mechanical properties of the housing material chosen and the size constraints of the modular jack connector 100 design, the design of which being well within the capability of one of ordinary skill given the present disclosure.

It will also be appreciated that the exemplary disposition of the feature 114 substantially within the plane of the sidewall as shown in FIG. 1A allows for some degree of space conservation; i.e., volume that would otherwise be consumed by the sidewall is instead allocated to portions of the feature 114, thereby economizing on space (such as to e.g., allow for more components to disposed within the interior volume of the connector housing, or increase inter-component distances such as for improved cross-talk or EMI performance), and overall connector size if desired.

Figure 1B:
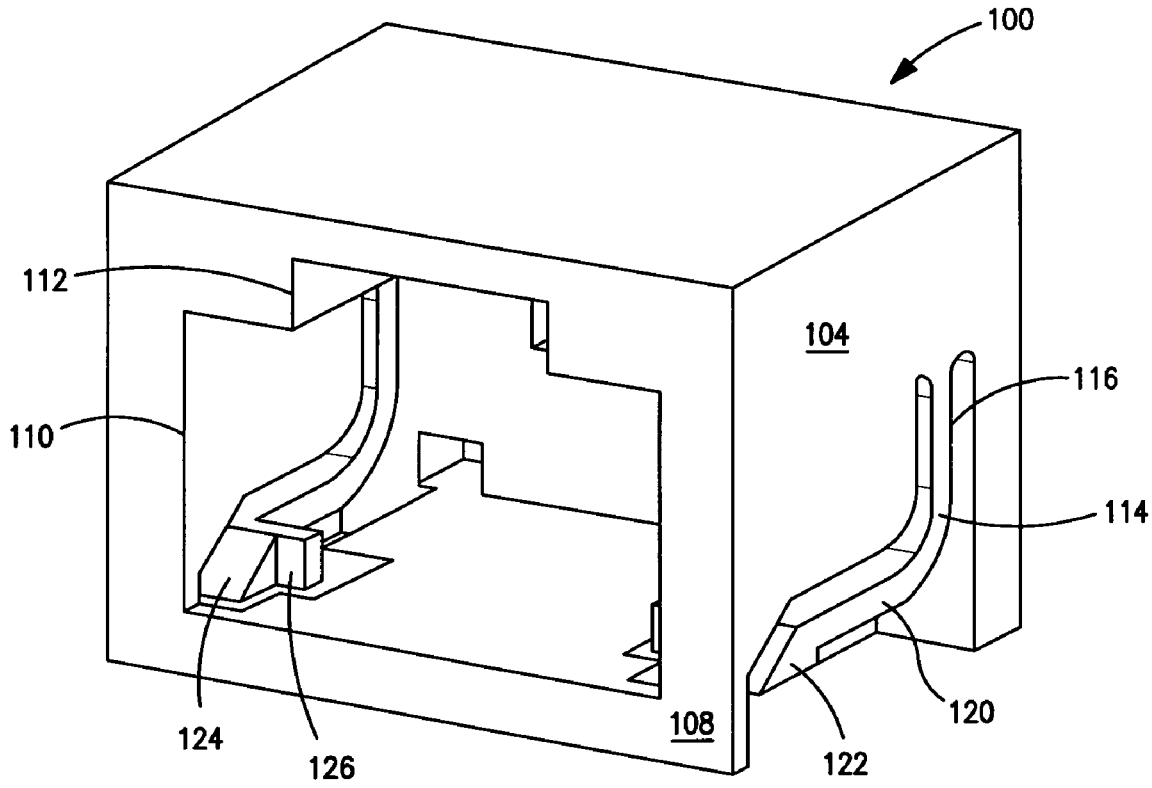
FIG. 1B is a reverse front perspective view of the first embodiment of the modular jack connector shown in FIG. 1A.

Referring now to FIG. 1B, a reversed front perspective view of the modular jack connector 100 of FIG. 1A illustrates perhaps the best view for discussing the operation of each of the keep-out features 114. The keep-out head section 122 of the keep-out feature 114 resides at the distal end of the second cantilever arm section 120. The exemplary head section 122 comprises a ramp section 124 and a stop portion 126 immediately adjacent to the ramp section and is largely responsible for ensuring that an improper plug does not get inserted into the modular jack port 110. For example, the embodiment of FIG. 1B is sized to accept insertion of an 8-position modular plug (e.g. an RJ-45 plug), while rejecting other types of modular plugs such as an RJ-11 modular plug.

If an improper plug, such as the aforementioned RJ-11 plug, is inserted into the modular jack cavity 110, the stop portions 126 of the keep-out feature 114 will prevent the plug from being inserted far enough to make electrical contact with the contactors (not shown for clarity) present within the modular jack 100. However, if an appropriate plug (such as an RJ-45 plug) is inserted, the front face of the plug will engage the ramp portions 124 of the keep-out features 114 and displace the head section 122 of the keep-out feature out of the way, thereby clearing the cavity 110 for insertion of the modular plug.

Another salient advantage of the present embodiment over prior art attempts at mitigating improper plug insertion is that the keep-out feature 114 may be integrally molded (via injection molding processes and the like) so that the additive cost of including a keep-out feature within the modular jack is minimized. Therefore this desirable feature can be included with little or no cost to the manufacture of the modular jack connector providing a distinct competitive advantage over many prior art solutions. In addition, as manual assembly processes are avoided, part to part consistency is also maximized as standard quality control procedures can ensure consistent production of the modular jacks over the life of the tooling for the modular jack.

Yet another important feature of the embodiment of FIG. 1A is the comparatively long length of the feature 114 (i.e., measured from the point of the cantilever 116 where it is formed to the housing, to the distal end (head section 122). From a mechanical and materials standpoint, this greater length (as compared to prior art solutions) allows for less stress on the material of the feature and housing. As an illustration, a similar feature having an effective length of a meter (1 m), if feasible, would place very little stress on the attachment point to the housing and the materials of the feature itself for a given amount of head portion deflection. Conversely, a feature having an effective length of 10 mm would encounter very significant (fatigue) stress for the same required deflection of the head portion 122. Stated simply, by being longer, the illustrated feature 114 is likely to last longer than comparable prior art solutions given the same number of cycles, since its stresses are lower.

Another key feature or distinction is the fact that the embodiment of FIGS. 1A and 1B (and even other embodiments disclosed herein) use a feature which is both disposed substantially within the plane of the connector sidewall, and not coupled or originated at the back wall 109 of the device.

Figure 2A:
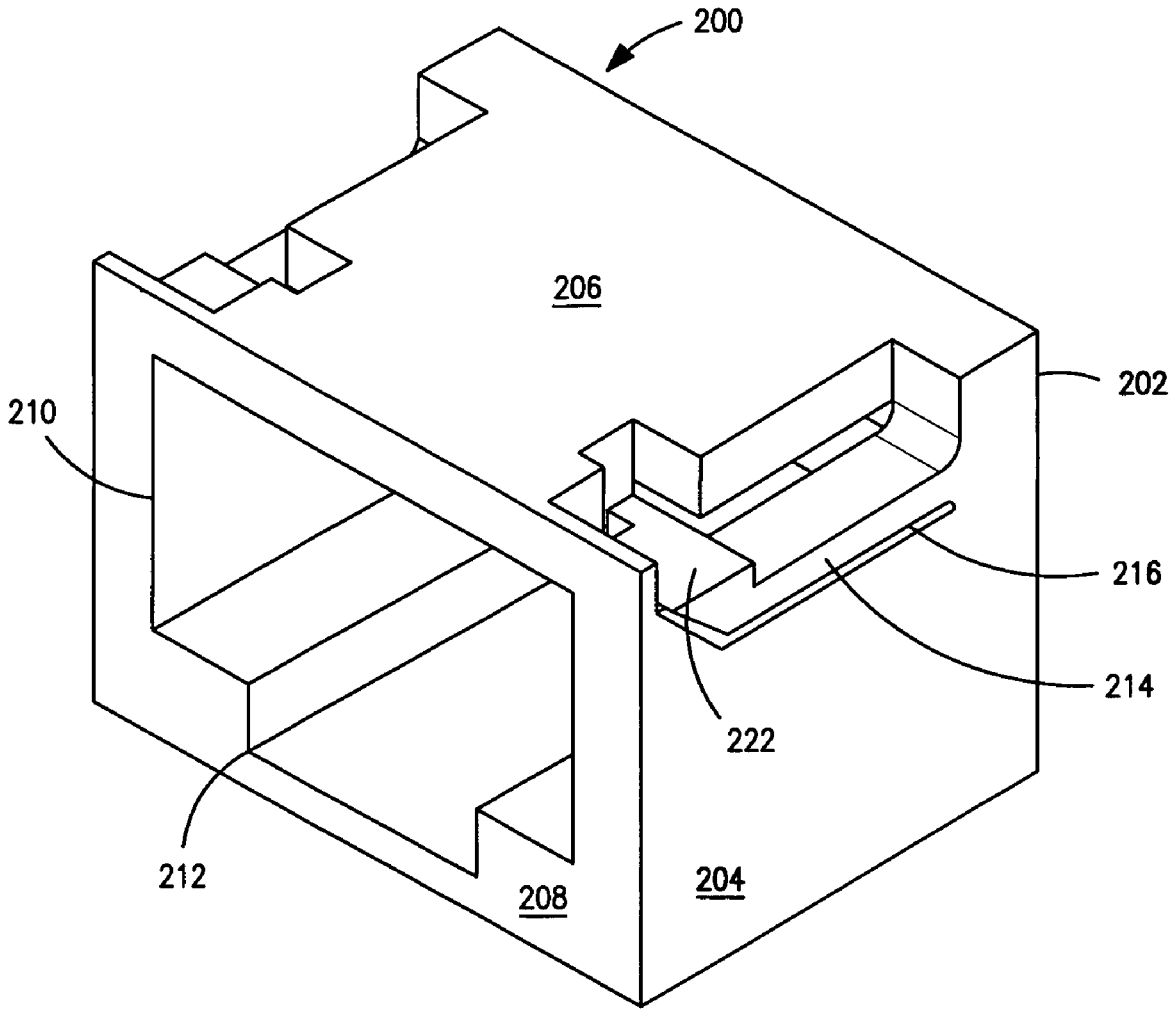
FIG. 2A is a front perspective view of a second embodiment of a modular jack connector incorporating an integrated keep-out feature.

Referring now to FIG. 2A, a second embodiment of a modular jack connector 200 incorporating integrated keep-out features 214 is shown and described in detail. The modular jack 200 shown in FIG. 2A is intended to be generalized and may readily be incorporated into any number of modular connector designs, such as e.g., those incorporated by reference previously herein.

Similar to FIGS. 1A and 1B, the modular jack connector 200 of FIG. 2A comprises a housing 202 made of an insulating material. The housing 202 is defined by side walls 204, front wall 208 and top and bottom walls 206 and may take on any number of geometric shapes such as those disclosed in the aforementioned U.S. Patents previously incorporated herein by reference. The port 210 shown is a tab down 212 configuration, although it is recognized that a tab up configuration (i.e. where tab 212 is positioned adjacent to top wall 206) may be readily adapted to the modular jack connector 200 shown in FIG. 2A.

The modular jack connector 200 of the second embodiment incorporates two keep-out features 214 into the housing 202 of the modular jack connector 200. The keep-out feature 214 is integrally molded into the side wall 204 of the housing 202 and projects in a direction generally parallel to the plug insertion direction. The first cantilever arm section 216 extends towards the front face 208 of the modular jack 200 via filleted joints which serve to strengthen the interface between the side wall 204 and the keep-out feature 214. The length of the first cantilever section 216 is governed largely by the mechanical properties of the housing material chosen, the design of which being well within the capability of one of ordinary skill given the present disclosure. Comparing the present embodiment with that shown in FIG. 1A, the keep-out feature 214 of the present modular jack 200 possesses a length shorter then the keep-out feature 114 of FIG. 1A and hence the material chosen for modular jack 200 may require properties which differ from those chosen in the modular jack 100 of FIG. 1A. However, this may not be necessary if for instance the size of features located on the head section 222 of the keep-out feature 214 are resized appropriately (i.e. to change the amount of deflection required to move the keep-out feature 214 out of cavity 210).

Figure 2B:
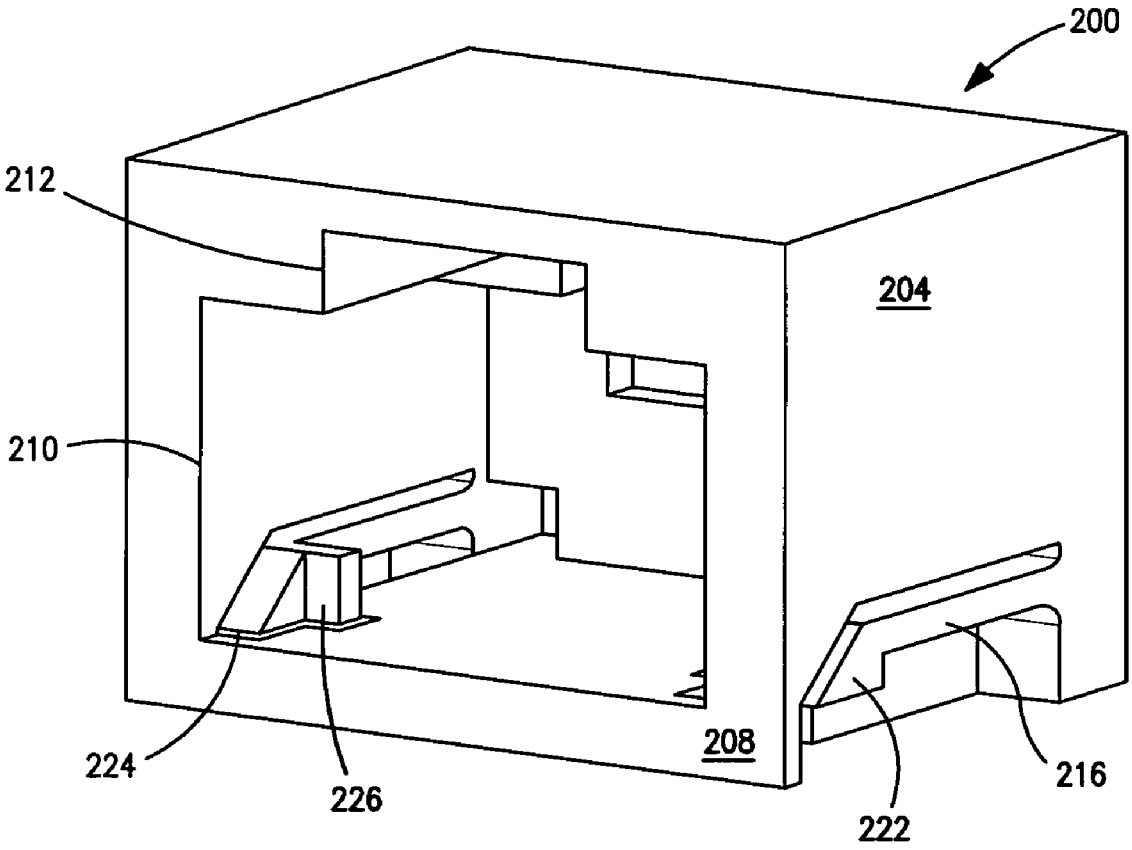
FIG. 2B is a reverse front perspective view of the second embodiment of the modular jack connector shown in FIG. 2A.

Referring now to FIG. 2B, the operation of the keep-out feature 214 is shown and described in detail and operates in a manner similar to those embodiments shown in FIGS. 1A and 1B. The keep-out head section 222 resides at the distal end of the cantilever arm section 216. The head section 222 comprises a ramp section 224 and a stop portion 226 and ensures that an improper plug does not get inserted into the modular jack port 210.

If an improper plug, such as for example the aforementioned RJ-11 plug, is inserted into the modular jack port 210, the stop portions 226 of the keep-out feature 214 will prevent the plug from being inserted far enough to make electrical contact with the contactors present within the modular jack connector 200. However, if an appropriate plug (such as an RJ-45 plug) is inserted, the front face of the plug will engage the ramp portions 224 of the keep-out features 214 and displace the head section 222 of the keep-out feature out of the way, thereby clearing the cavity 210 for insertion of the modular plug.

Figure 3A:
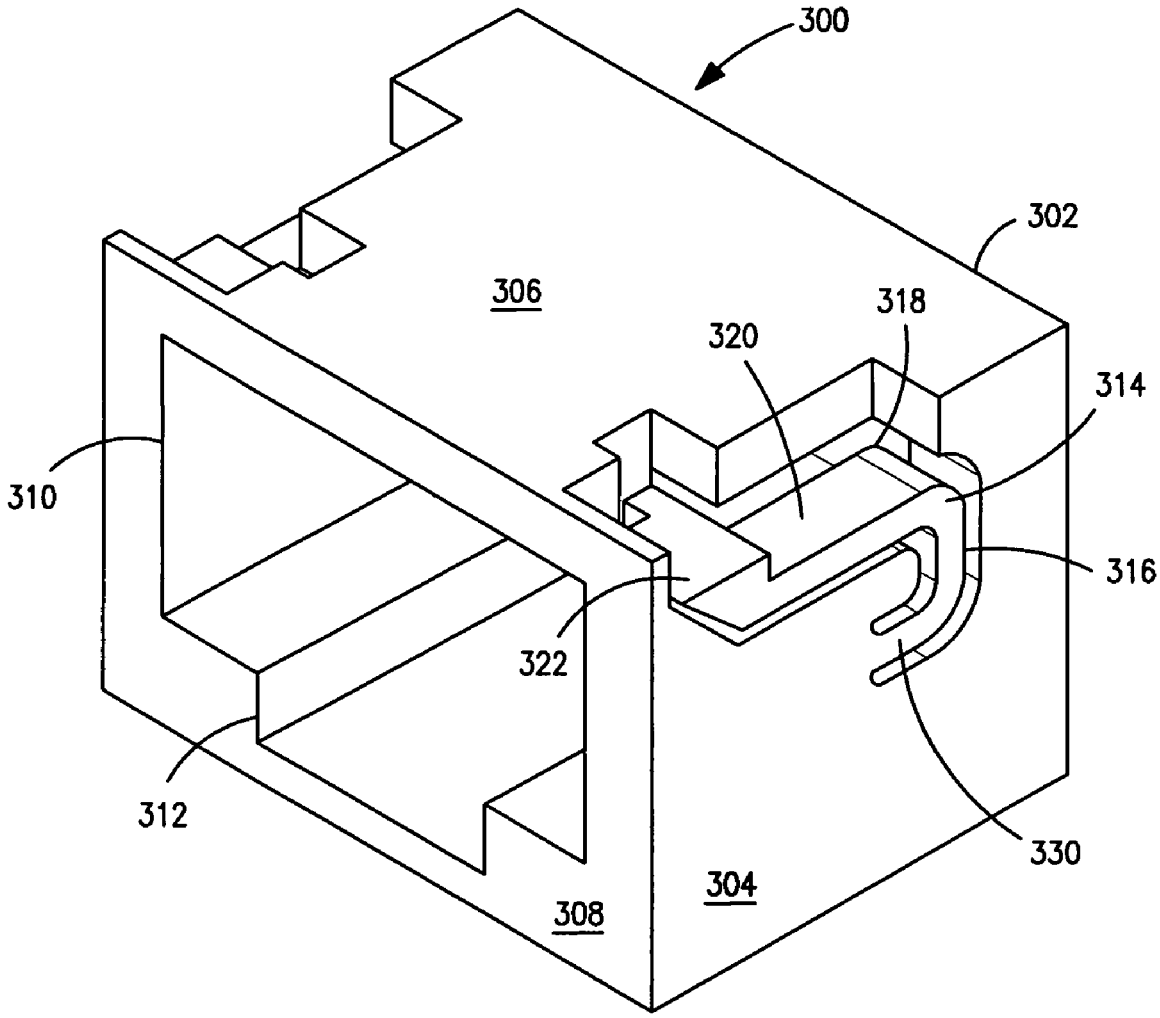
FIG. 3A is a front perspective view of a third embodiment of a modular jack connector incorporating an integrated keep-out feature.

Referring now to FIG. 3A, yet another embodiment of a modular jack connector 300 incorporating integrated keep-out feature 314 functionality is shown and described in detail. The modular jack 300 shown in FIG. 3A is intended to be generalized and may readily be incorporated into any number of modular connector designs such as those shown in any of the aforementioned U.S. Patents previously incorporated herein.

The modular jack connector 300 of FIG. 3A comprises a housing 302 made of an insulating material such as a thermoset or thermoplastic polymer material ubiquitous in the electronic connector arts. The housing 302 is again generally defined by its side walls 304, front wall 308 and top and bottom walls 306 although it is recognized that the housing may take any number of geometric shapes consistent with those U.S. Patents previously incorporated herein by reference.

The modular jack connector 300 of the third embodiment incorporates two keep-out features 314 integrally molded into the insulative housing 302 of the modular jack connector 300. The keep-out feature 314 is advantageously integrally molded within the side wall 304 of the housing 302 and projects first in a direction generally parallel to the plug insertion direction. The first cantilever arm section 330 extends away from the front face 308 of the modular jack 300 via filleted joints which serve to strengthen the interface between the side wall 304 and the respective keep-out feature 314. The first cantilever arm section 330 then transitions into a vertically extending section 316 followed by a third cantilever arm section 320 via radial sections 318. The first and third cantilever arm sections 330, 320 run generally parallel to one another in the present embodiment, however the design is not so limited and any number of geometries (parallel or otherwise) may readily be incorporated by one of ordinary skill given the present disclosure.

Figure 3B:
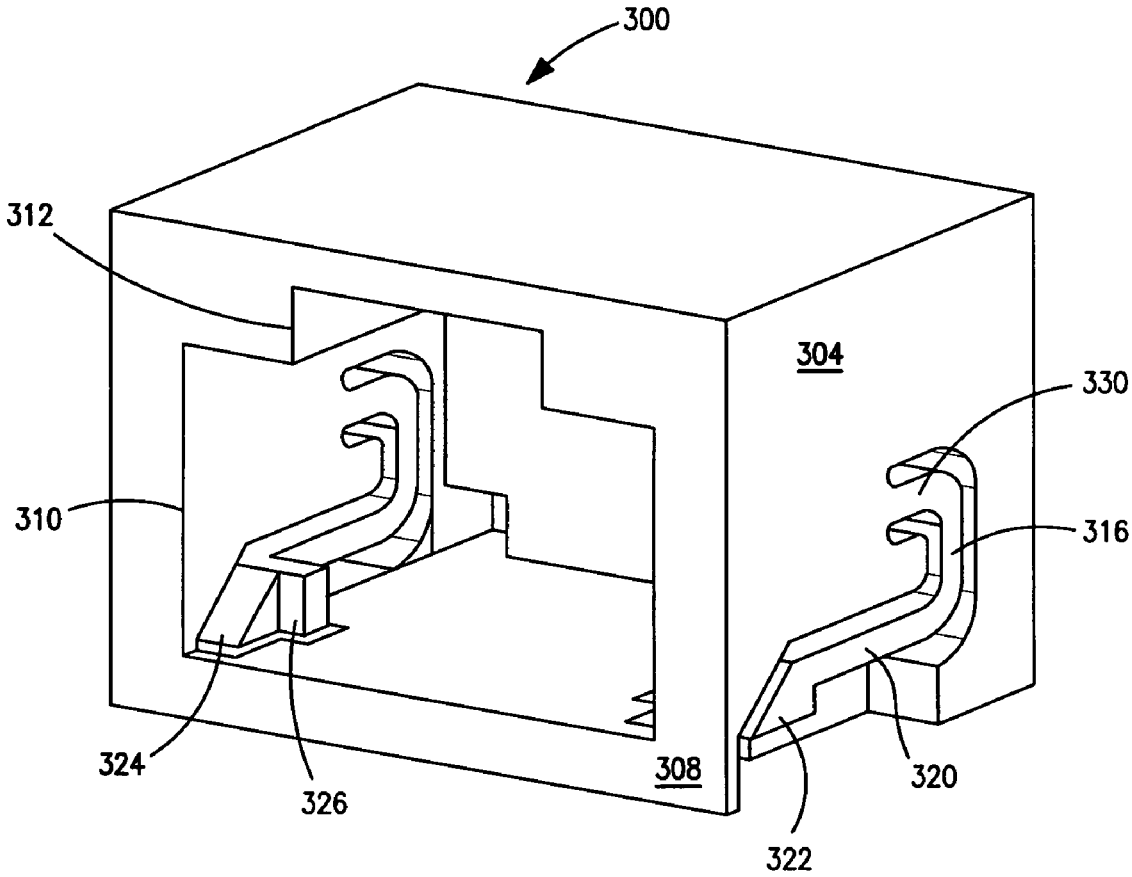
FIG. 3B is a reverse front perspective view of the third embodiment of the modular jack connector shown in FIG. 3A.

Referring now to FIG. 3B, the operation of the keep-out feature 314 is shown and described in detail and operates in a manner similar to those embodiments shown in FIGS. 1B and 2B. The keep-out head section 322 resides at the distal end of the cantilever arm section 320. The head section 322 comprises a ramp section 324 and a stop portion 326 and ensures that an improper plug does not get inserted into the modular jack cavity 310.

If an improper plug (i.e. a plug smaller then the correctly sized plug) is inserted into the modular jack cavity 310, the stop portions 326 of the keep-out feature 314 will prevent the plug from being inserted far enough to make electrical contact with the contactors present within the modular jack 300. However, if an appropriate plug (such as an eight-position plug) is inserted, the front face of the plug will engage the ramp portions 324 of the keep-out features 314 and displace the head section 322 of the keep-out feature out of the way, thereby clearing the cavity 310 for insertion of the modular plug.

As will be recognized via inspection, the embodiment of FIGS. 3A and 3B has a feature with an effective length (and length of its arcuate section) even longer than that of the embodiment of FIGS. 1A and 1B. This provides the benefits previously described with respect to the embodiment of FIGS. 1A and 1B, but to an even greater degree.

Figure 4A:
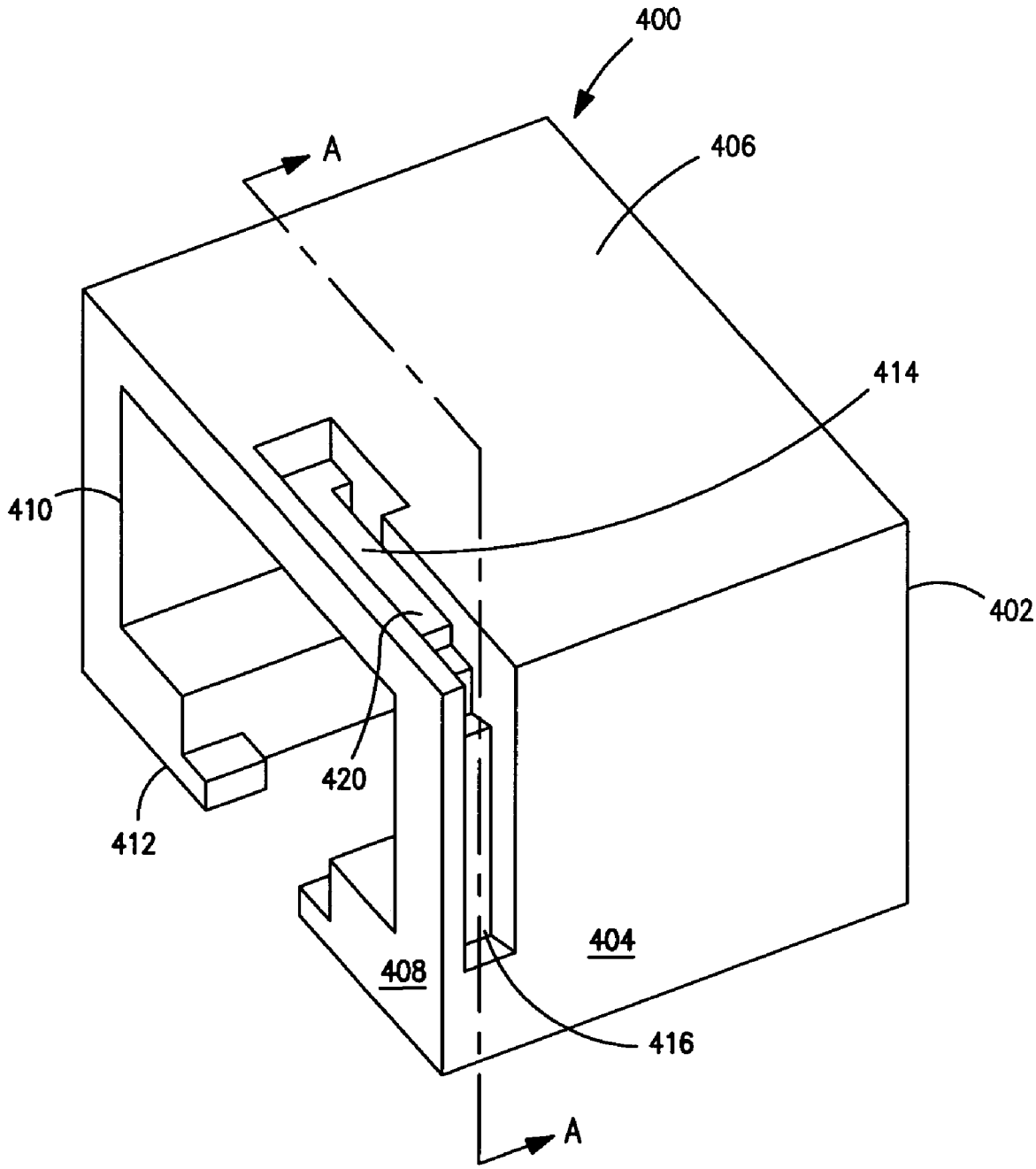
FIG. 4A is a front perspective view of a fourth embodiment of a modular jack connector incorporating an integrated keep-out feature.

Referring now to FIG. 4A, a fourth embodiment of a modular jack connector 400 incorporating a single keep-out feature 414 is shown and described in detail. The modular jack connector 400 shown in FIG. 4A is (similar to previous embodiments disclosed) is intended to be generalized and may readily be incorporated into any number of modular connector designs such as those shown in any of the aforementioned U.S. Patents previously incorporated herein. Similar to the previous embodiments, the modular jack connector 400 comprises a housing 402 made of an insulating material and is generally defined by side walls 404, front wall 408 and top and bottom walls 406.

The keep-out feature 414 of FIG. 4A may either be integrally molded into the housing 402 or comprise a distinct (i.e., separately formed) element or feature as is currently shown. The keep-out feature 414 may comprise an insulating material similar to that utilized in the housing 402, alternatively may be made from a metallic or alloy material such as a metal stamping as is shown in the illustrated embodiment, or yet other materials (e.g., non-metallic such as a different type of polymer than that used for the housing, a composite, etc.). The keep-out feature 414 of FIG. 4A first extends vertically along the side wall 404 and then along the top wall 406 as perhaps is best shown in the sectional view of FIG. 4C.

Figure 4B:
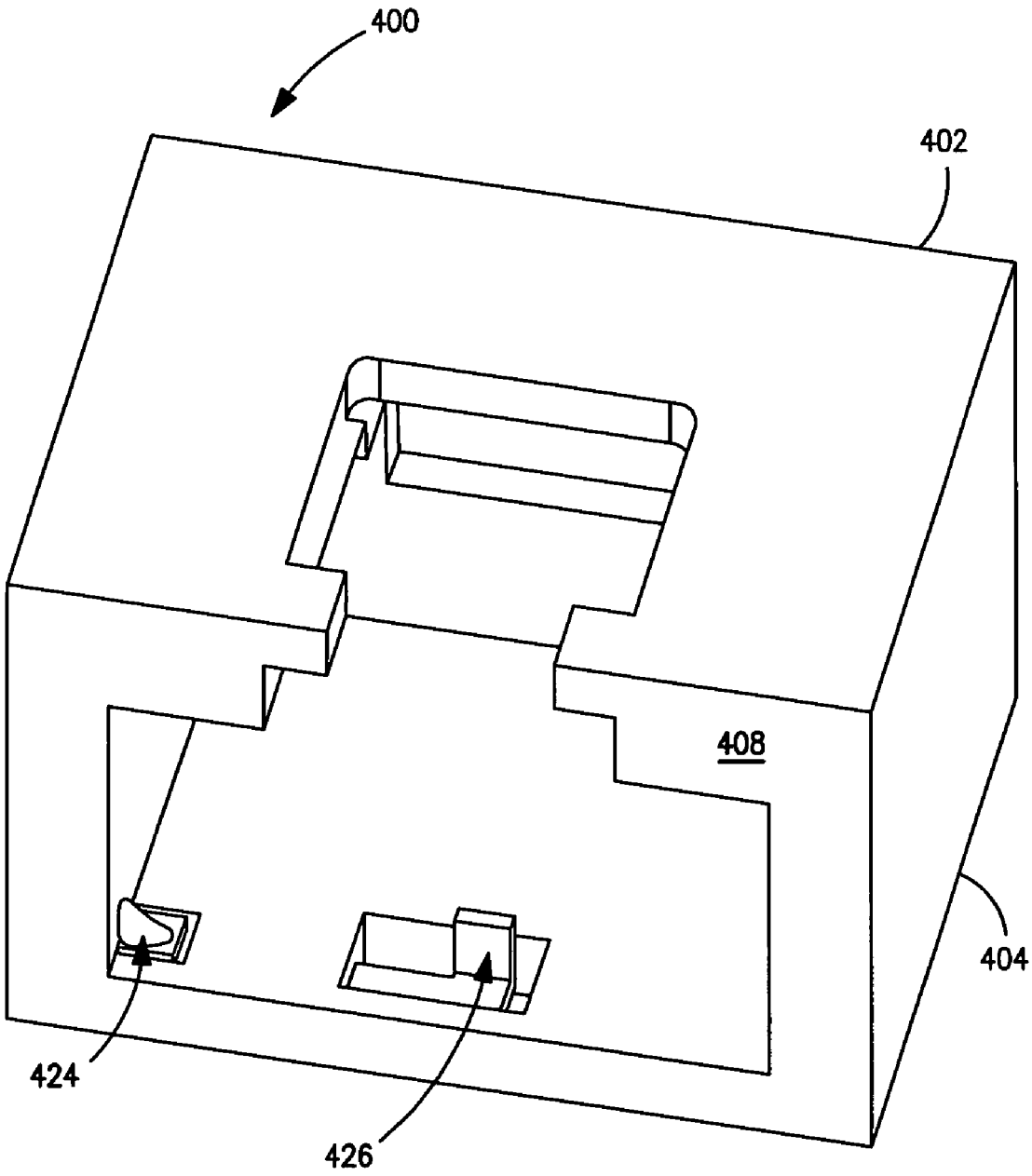
FIG. 4B is a reverse front perspective view of the fourth embodiment of the modular jack connector shown in FIG. 4A.
Figure 4C:
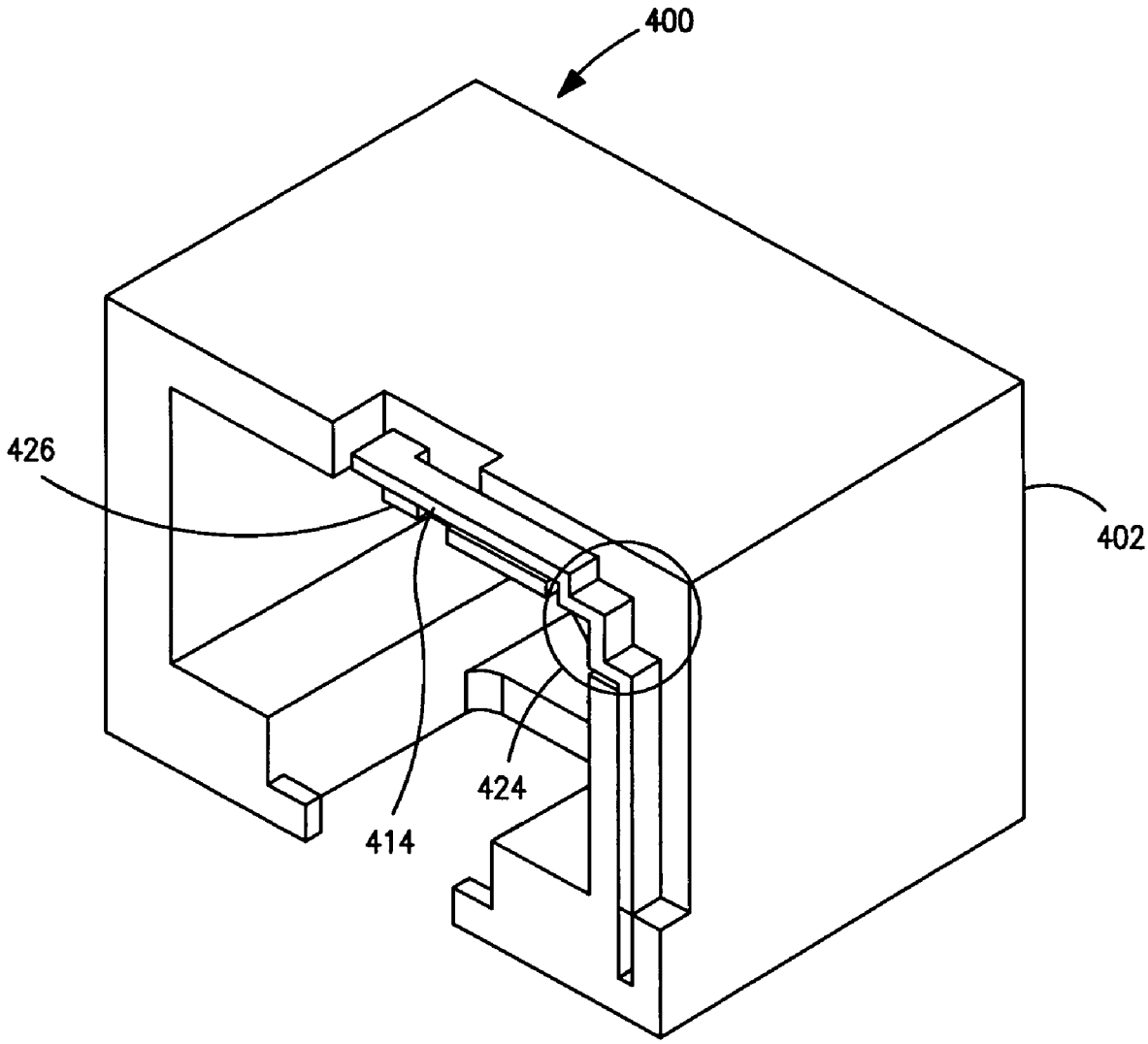
FIG. 4C is a front perspective sectional view taken along A-A of FIG. 4A.

Referring now to FIG. 4B, the ramp 424 and stop 426 portions of the keep-out feature 414 are shown and described in detail. Unlike the embodiments shown in FIGS. 1A-3B, the ramp 424 and stop 426 portions of the keep-out feature 414 of FIG. 4B are not immediately adjacent to one another. Rather, the stop portion 426 resides towards the center line of the modular jack connector 400, although the design is in no way so limited. The ramp feature 424 of the keep-out feature 414 (here, a somewhat rounded and angled surface projecting into the port) resides towards the edge of the modular jack port 410 so that it may only be engaged by a modular plug of a proper type. The use of a substantially rounded or curved cross-section feature 424 allows the contacting portion of the inserted plug to push the feature 424 upward, while also permitting the plug to move further in the longitudinal direction without binding. Other shapes may readily be used as well, however, the shape also to some degree being determined by its placement within the plug-receiving cavity. For example, in one alternate variant, an angled or rotated "ramp" is used in place of the substantially rounded shape previously described.

Figure 4D:
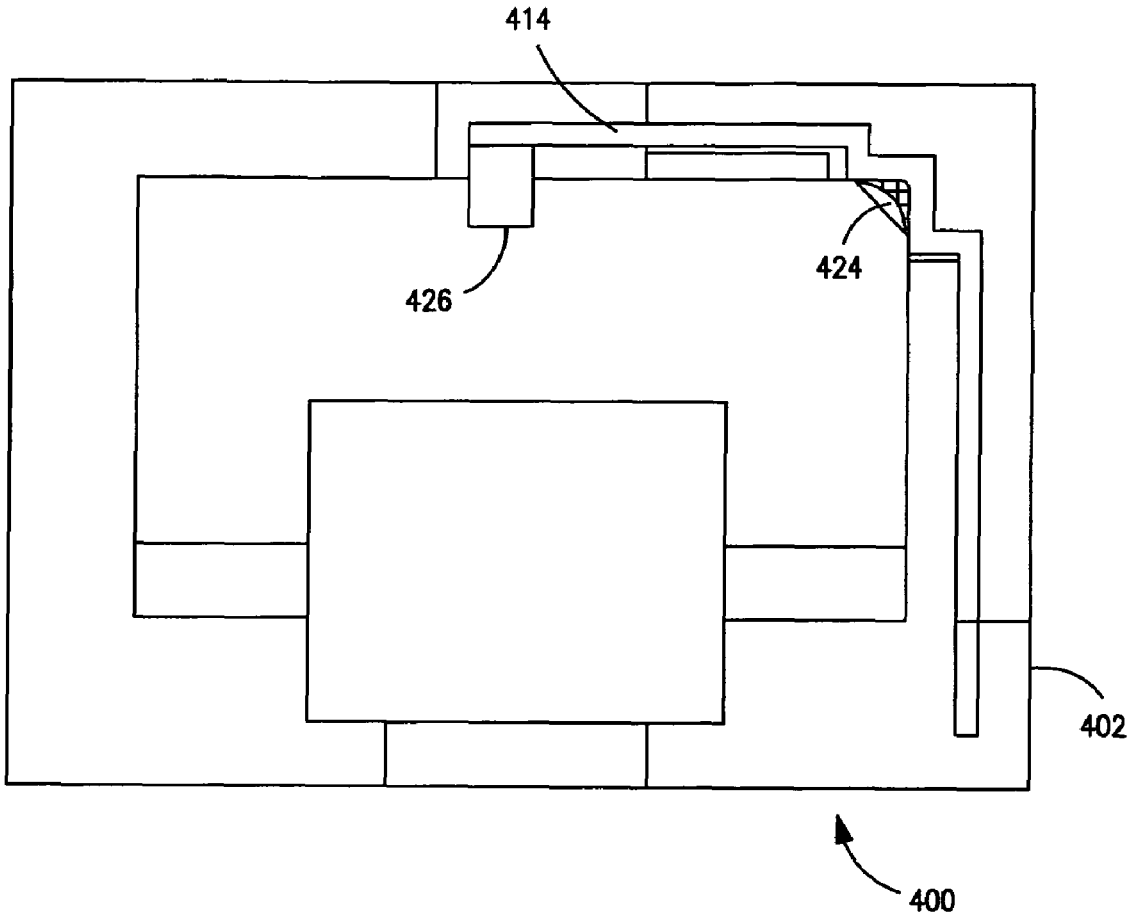
FIG. 4D is a front sectional view of the fourth embodiment of the modular jack connector shown in FIGS. 4A-4C prior to the insertion of a modular plug connector.
Figure 4E:
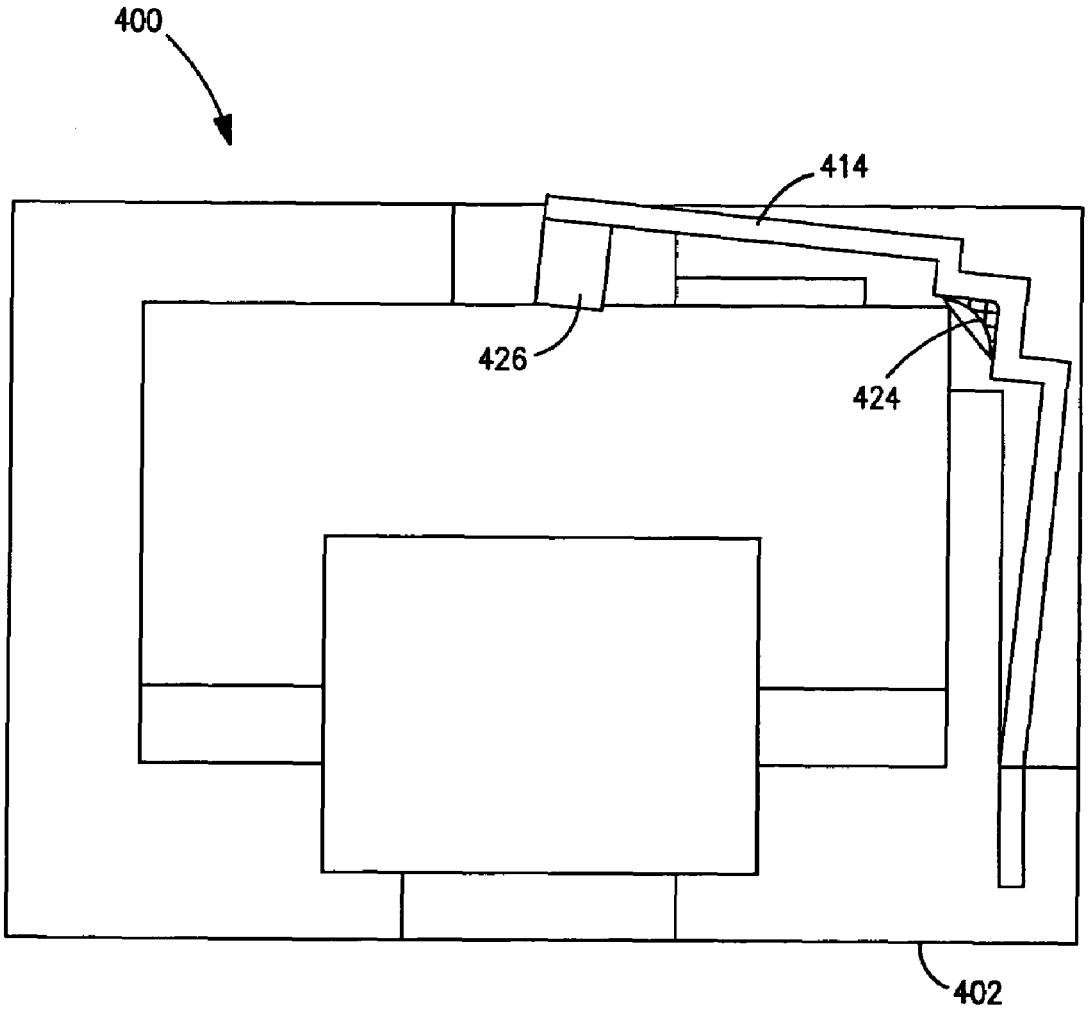
FIG. 4E is a front sectional view of the fourth embodiment of the modular jack connector shown in FIGS. 4A-4C after the insertion of a modular plug connector.

The operation of the modular jack 400 of FIG. 4A is perhaps best shown at FIGS. 4D and 4E. FIG. 4D demonstrates the state of the keep-out feature 414 should an improper modular plug be inserted. Because the improper modular plug is not shaped to engage the ramp portion 424 of the keep-out feature, the stop portion 426 remains within the cavity 410 of the modular jack connector thereby preventing the insertion of the modular plug. FIG. 4E on the other hand demonstrates the state of the keep-out feature 414 when the proper modular plug is inserted into the modular jack connector 400. The proper modular plug will engage the ramp portion 424 thereby biasing the stop portion 426 of the keep-out feature 414 out of the port 410 so that the plug may be inserted into the modular jack connector 400.

As with the embodiments of FIGS. 1A and 1B, and 3A and 3B, the effective length of the feature 414 of FIGS. 4A and 4B is increased over prior art solutions, thereby Providing similar benefits to those previously described, especially in the case where the feature 414 is molded or formed as an integral part of the housing.

It is also appreciated that various modifications to the embodiments discussed in FIGS. 1A-4E could readily be achieved by one of ordinary skill. For example, indicator lights (e.g. LEDs, etc.) could readily be adapted into the modular jack designs of the aforementioned embodiments. For instance, LEDs (such as those disclosed in FIG. 1b of U.S. Pat. No. 6,773,298 previously incorporated by reference herein) could be incorporated into the front face 108 of the modular jack housing 102 of FIG. 1A. In another variation, LEDs may be incorporated into the front face 208 of the modular jack housing 202 of FIG. 2A via methods similar to those disclosed in FIG. 1b of U.S. Pat. No. 6,325,664 previously incorporated herein by reference in its entirety.

It will also be understood that the placement of the light sources within the connector housing 102 may be varied. For instance, various optical media could be utilized in conjunction with the modular jack such as the light pipe media disclosed in FIG. 4b of U.S. Pat. No. 6,962,511 incorporated herein by reference in its entirety.

In addition to indicator lights such as the embodiments discussed above, EMI shielding such as that disclosed in U.S. Pat. No. 6,325,664 previously incorporated by reference in its entirety may be added to any of the previously disclosed embodiments if desired. See, e.g., FIG. 2*b* thereof. Various modifications and permutations to the aforementioned single port modular jack embodiments would be apparent to one of ordinary skill given the present disclosure herein.

Multi-Port Embodiment

Figure 5:
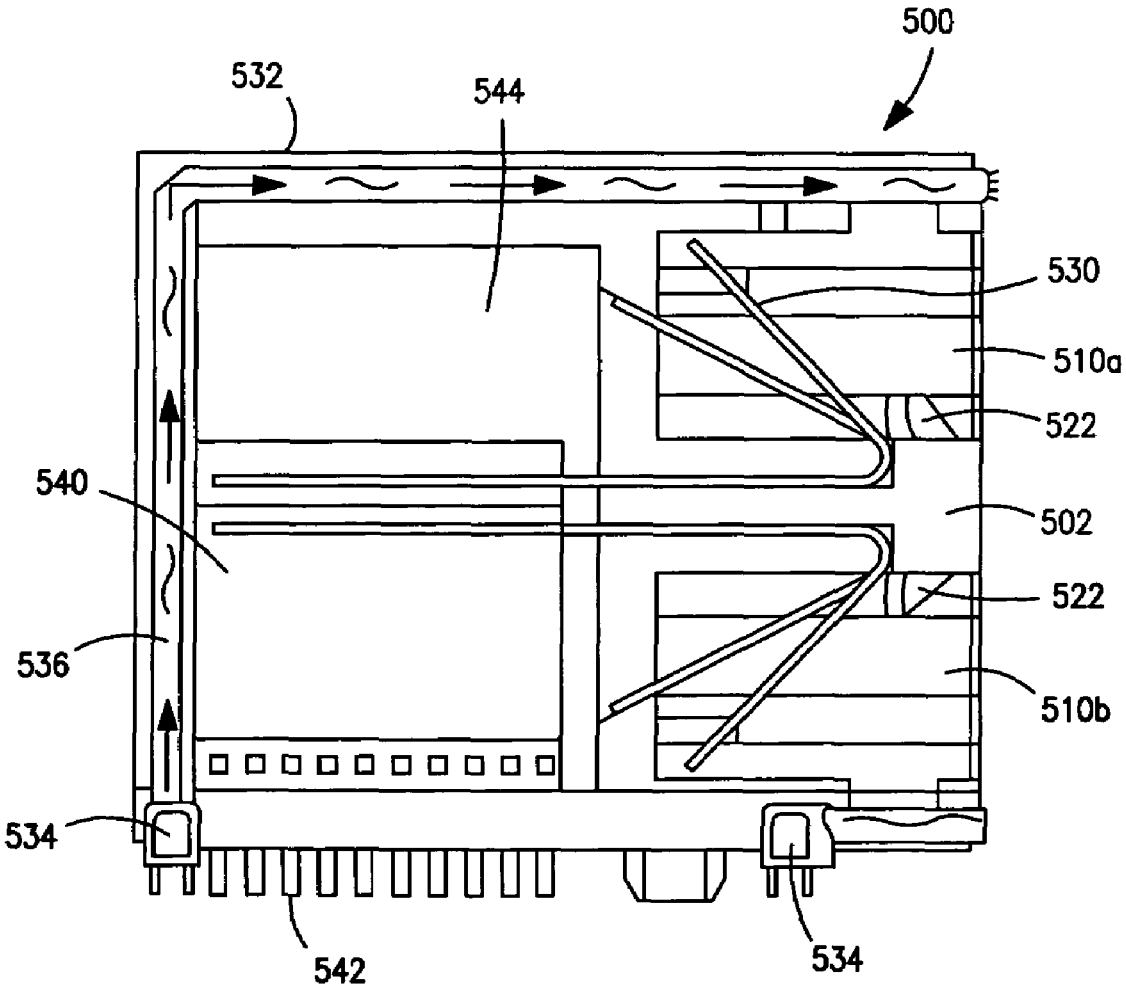
FIG. 5 is cross-sectional view detailing a 2×N multi-port embodiment of a modular jack connector incorporating integrated keep-out feature functionality.

Referring now to FIG. 5, a first multi-port embodiment of a modular jack connector 500 manufactured in accordance with the principles of the present invention is shown and described in detail. The modular jack connector 500 of FIG. 5 comprises a 2×N configuration in which individual ports 510 of the modular jack 500 are arranged in rows and columns. In the present embodiment shown, the modular jack connector 500 comprises an upper port 510*a* and a lower port 510*b*. Each port 510 has an integrated keep-out feature 522, such as those previously described with regards to FIGS. 1A-4E above.

The multi-port embodiment of FIG. 5 comprises an insulative housing 502 separated into plug receiving ports 510 and an electronic component containing space 544. The electronic component containing space 544 may optionally contain a printed circuit board 540 upon which a plurality of electronic components may be mounted. In one embodiment the plurality of electronic components may comprise a plurality of toroidal coils in the form of transformers and choke coils which filter the incoming and/or outgoing signals to the modular jack 500. The electrical signals pass from the inserted modular plug via contactors 530 through the printed circuit board 540 to terminals 542 or vice versa. Surface mount electronic components may be utilized in conjunction with the aforementioned toroidal components to further signal condition electrical signals passing through the modular jack connector 500.

The modular jack connector 500 of FIG. 5 also optionally comprises a plurality of light sources 534 (e.g. light-emitting diodes "LEDs" and the like). The light sources 534 for the upper port(s) 510*a* will be routed to the front of the modular jack connector 500 via optical media 536 (so-called light pipes) well known in the electronic connector arts. The modular jack connector housing 502 will also be substantially encased with EMI shielding 532 which acts to prevent and/or dissipate unwanted electrical signals from entering or exiting signals paths located within the modular jack connector 500.

Figure 6:
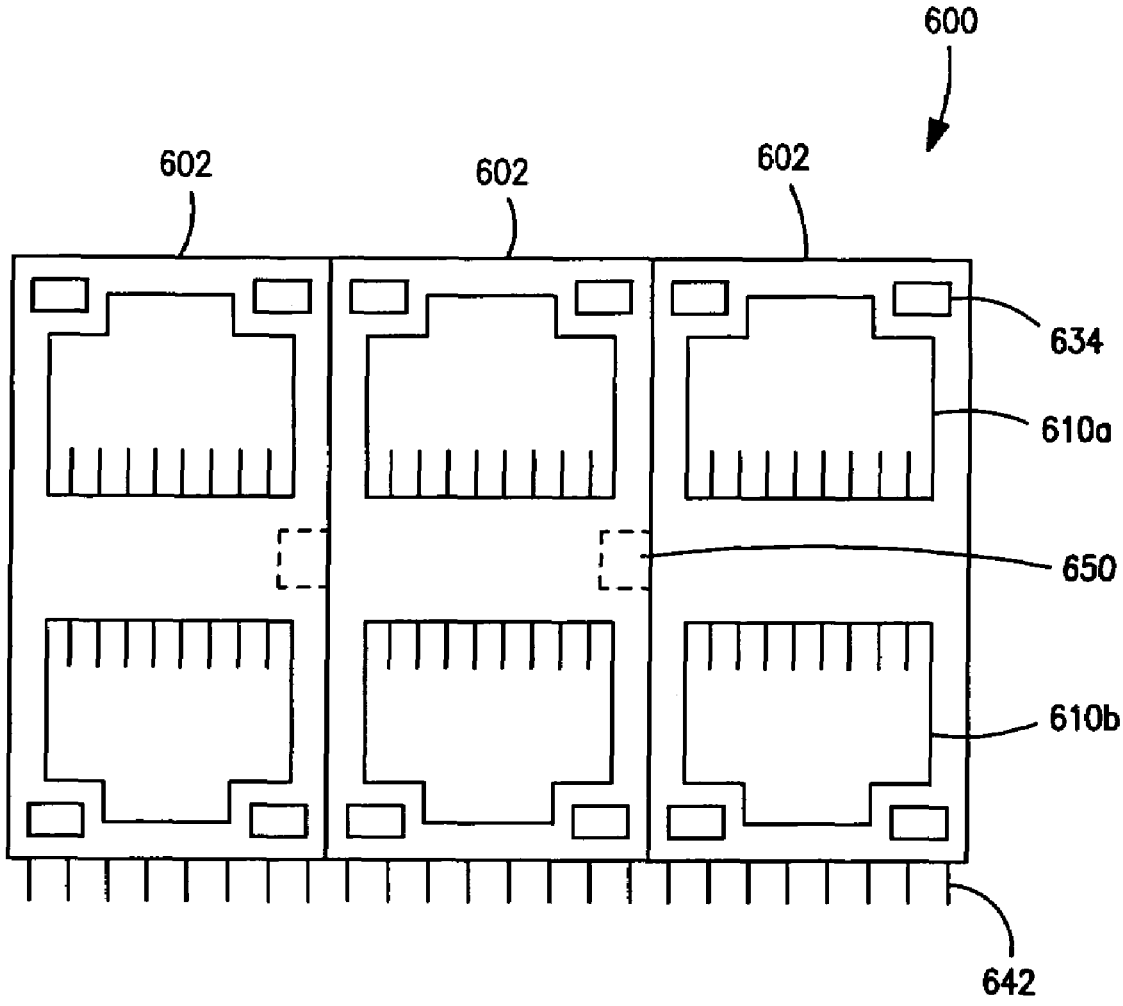
FIG. 6 is a front view detailing a 2×N multi-port embodiment of a modular jack connector incorporating an integrated keep-out feature.

Referring now to FIG. 6, a front view illustrating another embodiment of a multi-port 2×N modular jack connector 600 is shown and described in detail. The multi-port embodiment shown in FIG. 6 comprises three (3) distinct modular jack 2×1 housings 602. The modular jack housings 602 are "stacked" together to form a multi-port 2×N modular jack connector 600. The assembled modular jack connector 600 can then be substantially encased with a metallic shield (not shown) for purposes of improving EMI performance.

The modular jack housings 602 are preferably held together via connections 650. These connections 650 may comprise press-fitted posts or other means (e.g. cantilever snaps, adhesives, heat staking, etc.) suitable for combining the housings 602 into a unitary assembly. While the present embodiment of FIG. 6 illustrates these connections 650 occurring on a side wall of a modular jack housing 602, these connections 650 may readily be adapted on other faces as well such as the top, bottom, front and/or back face of the housing 602 or any other suitable combination of faces which meets other design constraints such as overall connector footprint and/or height.

Each port 610 of the modular jack connector 600 may optionally comprise light sources 634 which are useful to indicate the status of each of the upper 610*a* and lower 610*b* ports. Metallic terminals 642 provide electrical terminations to an external main printed circuit board (not shown).

Figure 7:
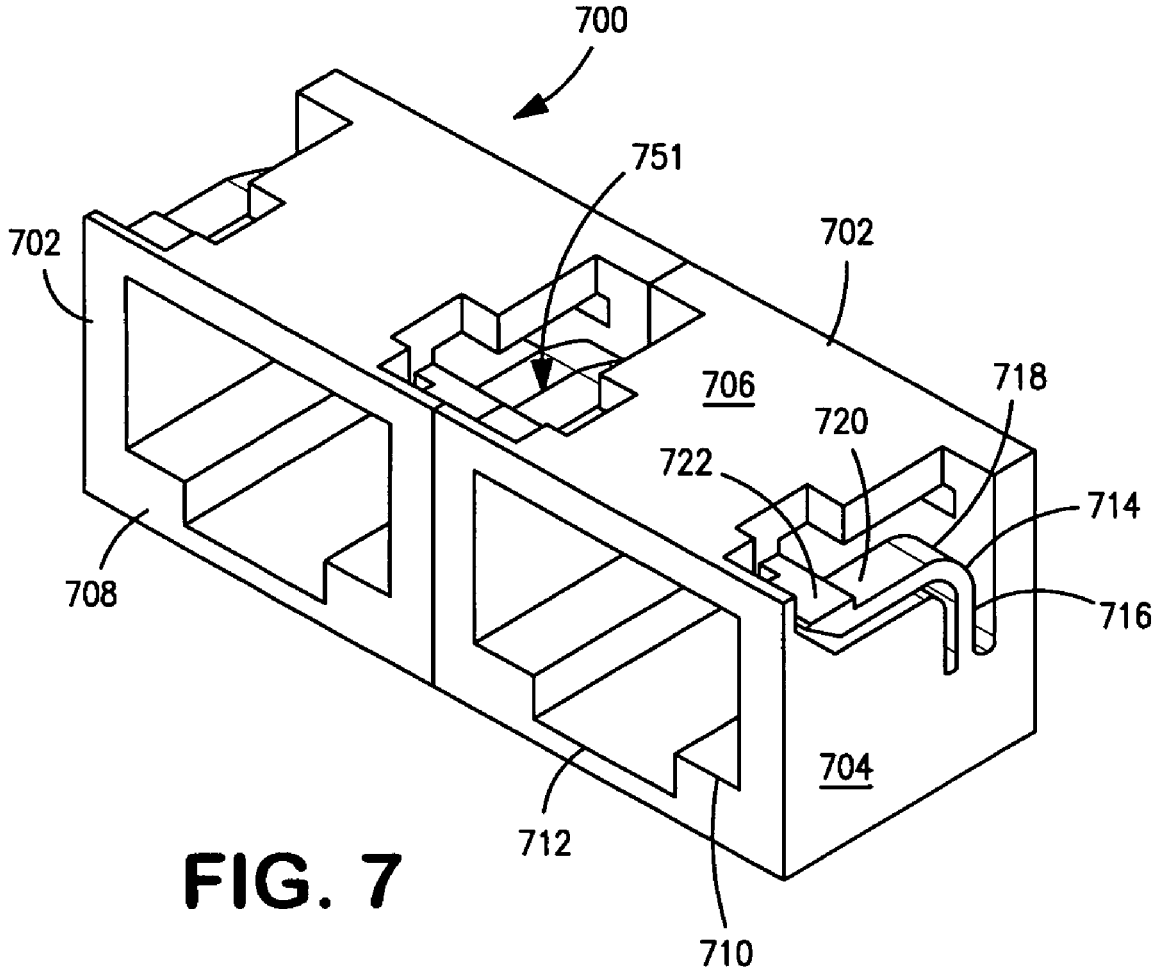
FIG. 7 is a front perspective view of a 1×N multi-port embodiment of a modular jack connector incorporating integrated keep-out feature functionality.

Referring now to FIG. 7, an exemplary embodiment of a 1×N multi-port modular jack connector 700 in accordance with the invention is shown and described in detail. The embodiment shown in FIG. 7 comprises two (2) modular jack housings 702 which are combined similarly to those methods discussed previously with regards to FIG. 6, although it is recognized that one of ordinary skill may readily adapt the present modular jack connector to be formed of a unitary housing assembly. However, such a unitary housing may add complexity to the mold of the connector and hence may not be desirable in all applications.

The multi-port modular jack connector 700 advantageously comprises a housing 702 made of an insulating material such as a thermoset or thermoplastic polymer material. The housing(s) 702 are generally defined by side walls 704, front wall 708 and top and bottom walls 706. The port(s) 710 shown in FIG. 7 are of the tab down 712 variety, although it is recognized that a tab up configuration (i.e. where tab 712 is positioned adjacent to top wall 706) may be readily adapted to the modular jack connector 700 shown in FIG. 7 by a person of ordinary skill given the present disclosure provided herein.

The modular jack connector 700 of the present embodiment incorporates two keep-out features 714 into each of the housings 702 of the modular jack connector 700. Each keep-out feature 714 is integrally molded into a respective side wall 704 of the housing 702 and first projects in a direction perpendicular to the plug insertion direction with the first cantilever arm section 716. The first cantilever arm section 716 extends in plane with the side wall 704 of the housing 702 via filleted joints which serve to strengthen the interface between the side wall 704 and its respective keep-out feature 714. Radial section 718 of keep-out feature 714 transitions the first cantilever arm section 716 into a second cantilever arm section 720 which runs in a direction generally parallel to the modular plug insertion direction and generally perpendicular to the direction of the first cantilever arm section 716. The length of the first and second cantilever sections 716, 720 respectively are governed largely by the mechanical properties of the housing material chosen, the design of which being well within the capability of one of ordinary skill given the present disclosure.

The keep-out feature 714 operates similarly to those embodiments shown with respect to the single-port embodiments discussed with regards to FIGS. 1A-3B, although it is recognized that the keep-out feature discussed with regards to FIGS. 4A-4E may readily be incorporated into the multi-port connector 700 of FIG. 7.

As previously discussed with regards to the single-port embodiments, one distinct salient advantage of the present multi-port embodiment over prior art attempts at mitigating improper plug insertion is that the keep-out feature of FIGS. 5-7 may be integrally molded (via injection molding processes and the like) so that the additive cost of including a keep-out feature within the modular jack connector is minimized. Therefore this desirable feature can be included with little or no cost to the manufacture of the modular jack providing a distinct competitive advantage over many prior art solutions. In addition as manual assembly processes are avoided, part to part consistency is also maximized as standard quality control procedures can ensure consistent production of the modular jacks over the life of the tooling for the modular jack.

It is noted that in the illustrated embodiment of FIG. 7, the two interior keep-out features 714 (i.e., those placed directly juxtaposed at the center 751 of the assembly) are separately articulated; i.e., can move independent of one another. This prevents the situation where a properly sized plug inserted into one of the two ports causes one of the two keep-out features 714 (i.e., the interior one) of the other adjacent port to be deflected upward, thereby reducing that second port's "protection" to one feature (i.e., the one on the outer sidewall). However, it may be desirable in some circumstances to utilize such a scheme, such as e.g., where the costs of separately tooling the devices and mating them together is not offset by any gain in performance (i.e., surety that the one remaining feature 714 will effectively provide the necessary keep-out function).

Conversely, in the context of either single-port or multiple-port embodiments as disclosed herein, the two keep-out features 114, 214, 314, 714 associated with a given single port can be coupled or ganged to one another, such that their operation is not independent. For example, in one variant, the two (left and right) keep-out features 114 of FIG. 1A are coupled via a structure (e.g., bar) that resides in a lateral groove formed within the top surface of the housing (not shown). This approach may be desirable for, inter alia, cases where the sidewalls of the housing are required to be very thin, and hence the two features 114 would be subject to significant torsion (i.e., flex in a rotational or other direction not desired) if not otherwise coupled (stabilized) to one another.

Moreover, since the exemplary features described herein do not in any way extend beyond the plane of the outer sidewall of the housing (i.e., are at maximum flush, or further recessed), heterogeneous keep-out solutions can be used in the device of FIG. 7. For example, the approach shown in FIG. 1A may be used in a first connector, the approach of FIG. 2A in a second connector, and that of FIG. 3A in a third connector, and so forth.

It is also appreciated that various modifications to the embodiment(s) discussed with respect to FIG. 7 could readily be achieved by one of ordinary skill. For example, indicator lights (e.g. LEDs, etc.) could readily be adapted into the modular jack designs of the aforementioned embodiment(s). For instance, LEDs (such as those disclosed in FIG. 1b of U.S. Pat. No. 6,773,298 previously incorporated by reference herein) could be incorporated into the front face 708 of the modular jack housing 702 of FIG. 7.

It will also be understood that the placement of the light sources within the connector housing 702 may be varied. For instance, various optical media could be utilized in conjunction with the modular jack such as the light pipe media disclosed in FIG. 4b of U.S. Pat. No. 6,962,511 previously incorporated herein by reference in its entirety.

It will be further noted that each of the foregoing embodiments of the connector assembly of the invention may be outfitted with one or more external or internal noise/EMI shields in order to provide enhanced electrical separation and reduced noise between conductors and electronic components. As an example, the internal shielding arrangement(s) described in co-owned U.S. Pat. No. 6,585,540 entitled "Shielded Microelectronic Connector Assembly and Method of Manufacturing", filed Dec. 6, 2000, and assigned to the co-assignee hereof, incorporated by reference herein in its entirety, may be adapted for use with the present invention, whether alone or in conjunction with other such shielding methods. Specifically, the single- or multi-port port embodiments of the present invention may be fitted with a substrate shields to limit electromagnetic noise transferal through the bottom of the connector. Similarly, side- or lateral shield elements such as those taught in the foregoing application may be used between individual ones of the connectors in the multi-port embodiment of the present invention. An external or noise shield of the type illustrated in FIG. 5 herein, or other comparable design, may be employed in addition or in the alternative to the foregoing internal shields as well.

In addition, in some instances is may be desirable that one or more ports of the multi-port embodiments discussed with regards to FIGS. 5-7 not include keep-out features within the receptacle of that port 710. It is recognized that such a modification would be well within the capability of one of ordinary skill given the present disclosure herein.

In yet another embodiment, the ports used may be heterogeneous, with all or less than all of them being equipped with keep-out features. For example, a modular-over-USB configuration of the type well known in the networking arts may employ a modular jack with a keep-out feature, while the USB connector does not (i.e., USB connector form factor is effectively sui generis, and hence does not really require any sort of "keep-out" arrangement).

Shield-Based Variants

As is well known in the connector (and particularly modular jack) arts, noise shielding of the type previously described is very useful at mitigating inter alia internal or external EMI associated with the operation of high-frequency circuitry. Accordingly, such shielding is very typically present on connectors, and as described subsequently herein is used to advantage for purposes of excluding improperly sized plugs from the connector.

Figure 8A:
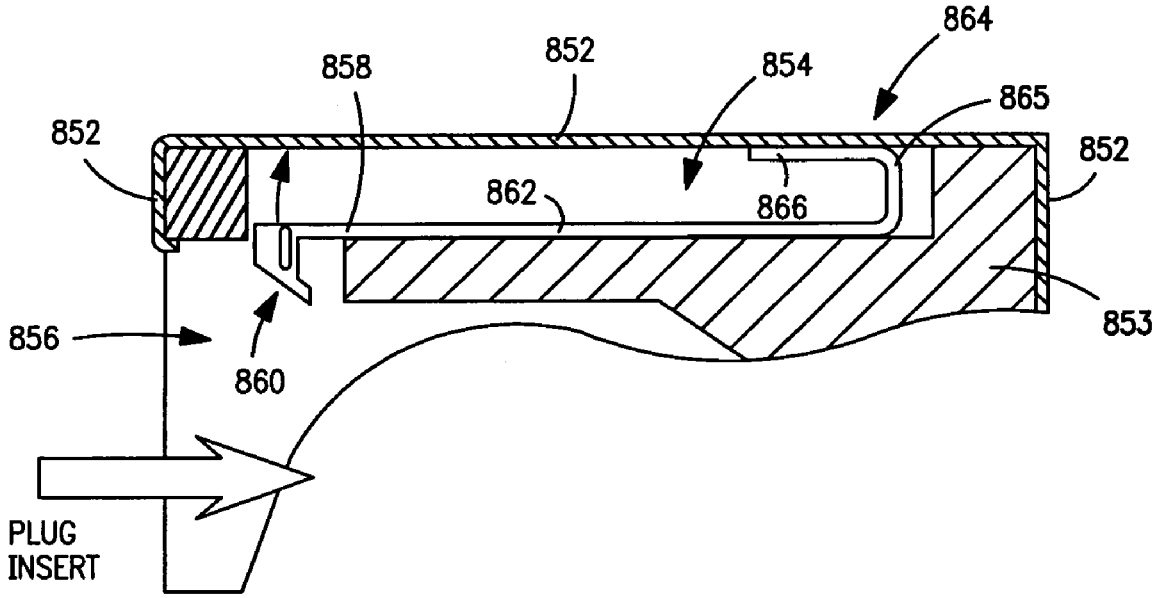
FIG. 8A is a partial side cross-sectional view of the top portion of a connector housing according to another embodiment of the invention, wherein a noise shield-captured keep-out-feature is utilized.

In one exemplary embodiment (FIG. 8A), the shield 852 comprises a wrap-around tin alloy Faraday shield of the type known in the art, although other configurations and materials may be used with equal success. The connector housing 853 comprises a plurality of grooves or slots 854 formed in its upper surface (and which communicate at least in some degree with the modular plug receiving port 856 of the housing); these slots contain respective somewhat free-floating metallic arm members 858 as shown. The arm members comprise a front abutment section 860, an elongated portion 862, and a rear retention portion 864.

The rear retention portion 864 comprises in the illustrated embodiment a curved or bent portion 865, and an upper shield contact portion 866 as shown. The upper contact portion 866 is configured to contact the interior side of the top wall of the shield 852, thereby effectively capturing the arm members 858 within the slots, and further allowing for the deflection of the members 858 when the proper sized plug is inserted into the port. Specifically, since the contact portion 866 is in contact with the substantially rigid shield 852, the curved portion 865 bends under upward deflection of the member 858 by the plug (in effect acts like a spring). The elongated portion 862 can be made to flex somewhat also if desired, thereby adding two levels of resiliency to the assembly.

Figure 8B:
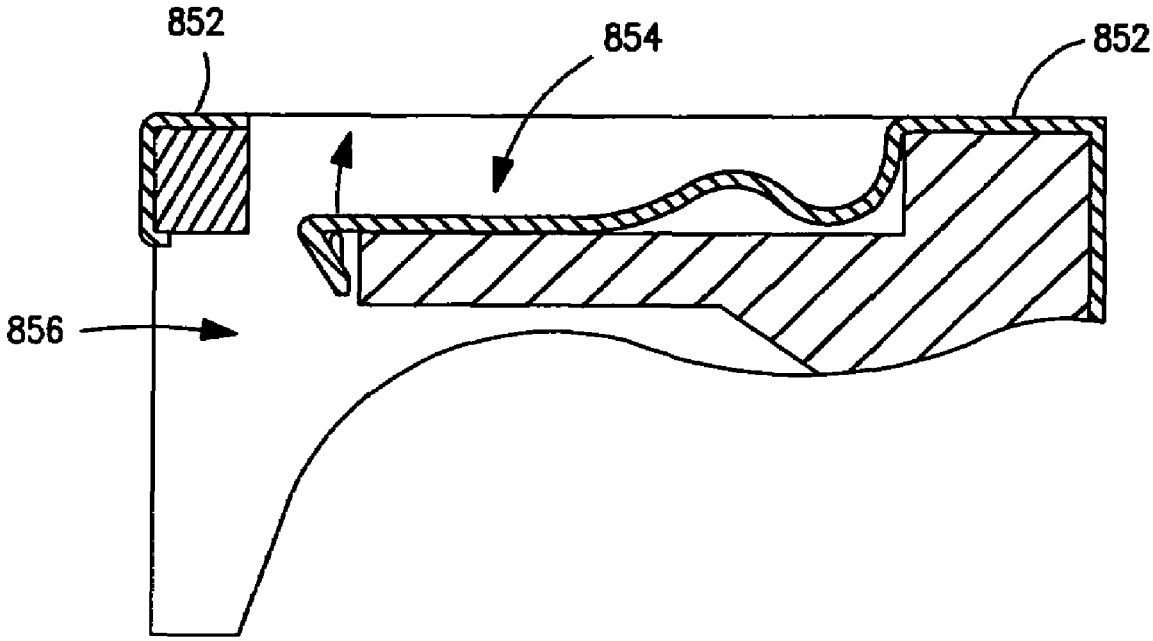
FIG. 8B is a partial side cross-sectional view of the top portion of a connector housing according to still another embodiment of the invention, wherein a keep-out-feature integral with the noise shield is utilized.

It will be appreciated that other configurations of springs or bias forces can be used consistent with the arm members 858 of the present invention. For example, in one variant (not shown), the contact portion is adapted to extend further forward in the slot, thereby making the arm members 858 more of a "U" shape than a "J" shape" as in the embodiment of FIG. 8A. Moreover, the arm members 858 may be formed of other materials that provide the desired properties (e.g., substantially rigid polymers, etc.), and may even comprise multiple discrete components. They may also be attached to the shield 852 (such as via an adhesive, tack- or other weld, etc.), and may even be formed as part of the shield (see, e.g., the exemplary approach of FIG. 8B).

Method of Manufacture

Figure 9:
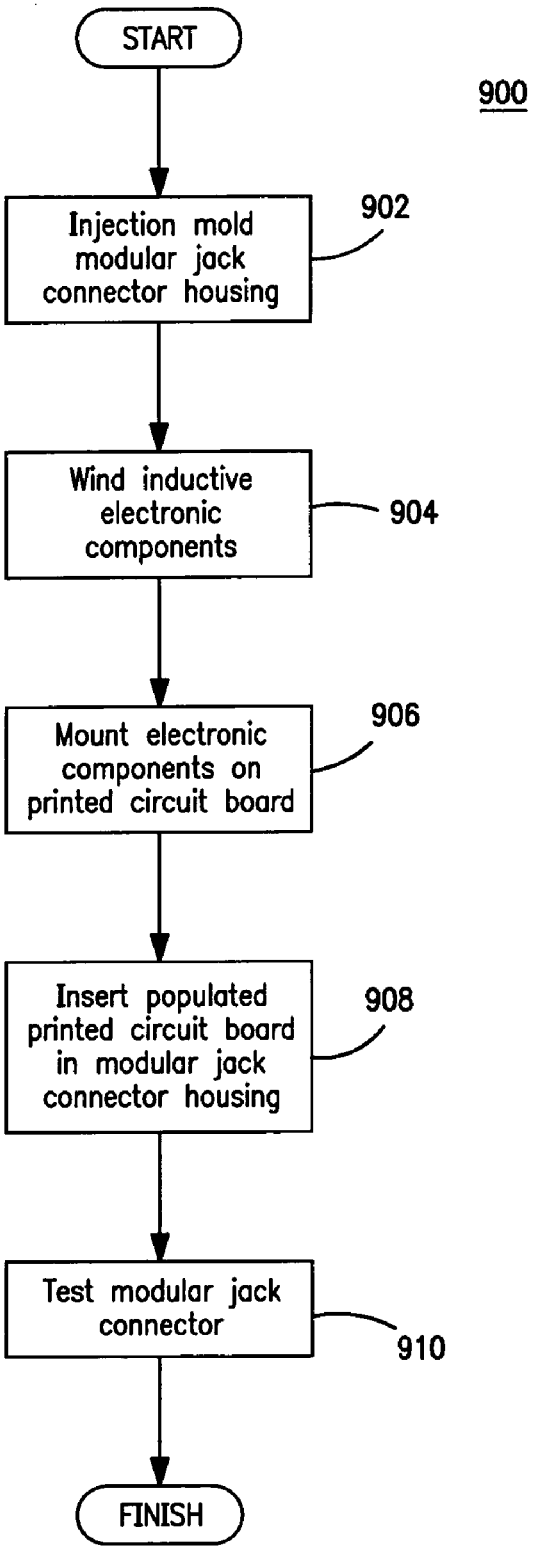
FIG. 9 is a logical flow diagram illustrating a first exemplary embodiment of the method of manufacturing a single-port modular jack connector in accordance with the principles of the present invention.

Referring now to FIG. 9, a method 900 of manufacturing the aforementioned single port modular jack connector (i.e. modular jack connectors 100, 200, 300, 400) is described in detail. It is noted that while the following description of the method 900 of FIG. 9 is cast primarily in terms of a single port modular jack connector assembly, the broader method of the invention is equally applicable to multi-port modular jack connectors with housings formulated from a unitary housing.

At step 902, the modular jack connector housing is injection molded using techniques well understood in the modular connector arts.

At step 904, any inductive electronic components used in the device are wound using well known techniques. These inductive electronic components may include, without limitation, toroidal transformers, choke coils, surface-mountable chip inductors and the like.

At step 906, any electronic components used in the device are mounted on a printed circuit board to be mounted inside of the modular jack connector. These electronic components can include, without limitation, those inductive electronic components manufactured at step 904 and/or other electronic components such as chip-type capacitors, integrated circuits and the like. These electronic components may be attached to the printed circuit board using well known techniques such as IR reflow, hand soldering, wave soldering and the like.

At step 908, the populated printed circuit board (if used) is inserted inside of the modular jack connector housing manufactured at step 902.

At step 810, the assembled modular jack connector is optionally tested to ensure compliance with both mechanical and/or electrical specifications.

Figure 10:
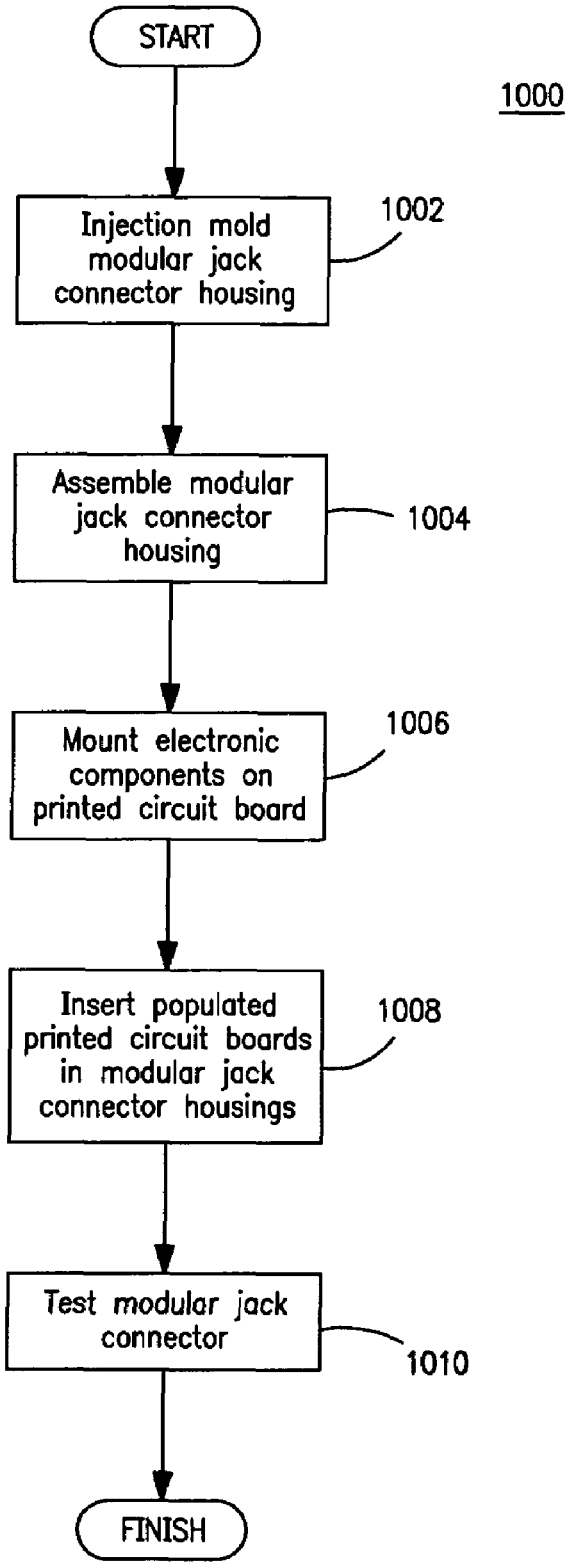
FIG. 10 is a logical flow diagram illustrating a second exemplary embodiment of the method of manufacturing a multi-port modular jack connector in accordance with the principles of the present invention.

Referring now to FIG. 10, a method 1000 of manufacturing the aforementioned multi-port modular jack connectors (i.e. modular jack connectors 500, 600, 700) is described in detail. At step 1002, the modular jack connector housings are injection molded using standard processing techniques well known in the modular connector arts.

At step 1004, the modular jack connector housings are assembled together to form the end product multi-port 2×N or 1×N modular jack connector. These modular jack connector housings are combined using those techniques previously discussed above such as cantilever snaps, press-fit posts, adhesives and the like.

At step 1006, electronic components (if used) are mounted on the printed circuit board (or other structure, if any) to be mounted inside of the multi-port modular jack connector. These electronic components can include, without limitation, inductive electronic components wound using well known techniques. These inductive electronic components may include, without limitation, toroidal transformers, choke coils, surface-mountable chip inductors and the like. These electronic components may also include other electronic components such as chip-type capacitors, integrated circuits and the like. These electronic components may be attached to the printed circuit board using well known techniques such as IR reflow, hand soldering, wave soldering and the like.

At step 1008, the populated printed circuit boards or other assemblies (if used) are inserted inside of the multi-port modular jack connector housing manufactured at step 1002.

At step 1010, the assembled multi-port modular jack connector is optionally tested to ensure compliance with both mechanical and/or electrical specifications.

With respect to the other embodiments described herein (i.e., connector embodiments with LEDs, etc.), the foregoing method may be modified as necessary to accommodate the additional components. For example, where an LED is used, the LED may be inserted into a housing using manufacturing processing steps such as those disclosed in U.S. Pat. No. 6,773,298 entitled "Connector assembly with light source sub-assemblies and method of manufacturing" previously incorporated herein by reference. Such modifications and alterations will be readily apparent to those of ordinary skill, given the disclosure provided herein.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A connector, comprising:

a connector housing, said connector housing comprising:

a plurality of side walls;

a first outer housing wall disposed substantially orthogonal to each of said plurality of side walls; and an opposing outer housing wall, said opposing outer housing wall disposed substantially opposite said first outer housing wall;

wherein said plurality of side walls, said first outer housing wall and said opposing outer housing wall collectively form a modular plug receiving cavity; and a keep-out feature integrated substantially within a plane of at least one of said plurality of side walls of said housing, said keep-out feature comprising:

a head portion further comprising:

a ramp feature and a stop feature, at least portions of both said ramp feature and said stop feature being disposed within said modular plug receiving cavity; and a cantilever beam portion comprising a first and a second beam portion, said cantilever beam portion comprising a width and a thickness, said width being greater than said thickness;

wherein said first beam portion deflects generally in the direction of said first outer housing wall when said cantilever beam portion is deflected;

wherein said second beam portion deflects generally in the direction associated with a plug insertion into said modular plug receiving cavity when said cantilever beam portion is deflected; and wherein both said first and second beam portions deflect substantially within an outer surface associated with said side wall with which said first and second beam portions are associated.

2. The connector of claim 1, wherein at least a portion of said integrated keep-out feature is accessible via an opening contained within said first outer housing wall.

3. The connector of claim 1, wherein said second beam portion is disposed near but not against a back wall associated with said housing when in a non-deflected state, said back wall acting as a barrier for said second beam portion during cantilever beam deflection.

4. The connector of claim 3, wherein said ramp feature is engaged by an inserted RJ-45 plug, thereby moving said stop feature out of the modular plug receiving cavity of said connector housing.

5. The connector of claim 4, wherein said connector comprises a tab-down configuration and said first outer housing wall is disposed substantially away from a notch in said modular plug receiving cavity associated with the tab-down configuration.

6. A connector, comprising:

a polymer connector housing having a plurality of walls comprising a top wall and a side wall, said side wall having a substantially vertical plane, said plurality of walls collectively forming at least a portion of a plug insertion cavity; and a keep-out feature comprising a ramp feature and an at least partly curved cantilever portion coupled to said ramp feature, said cantilever portion being formed as part of said side wall and disposed entirely within said substantially vertical plane of said side wall, even during actuation of said keep-out feature.

7. The connector of claim 6, wherein said keep-out feature substantially frustrates insertion of an incorrectly-sized modular plug in said cavity.

8. The connector of claim 7, wherein said keep-out feature is molded as part of said side wall as part of a common molding process.

9. The connector of claim 8, wherein said cantilevered portion projects in at least two directions thereby reducing stresses in said cantilevered portion and said connector housing.

10. The connector of claim 9, wherein said ramp feature is engaged by an inserted RJ-45 plug, thereby moving the ramp feature out of the plug insertion cavity of said connector housing.

11. The connector of claim 10, wherein said connector comprises a tab-down configuration, and said top wall is disposed substantially away from a notch in said plug insertion cavity associated with the tab-down configuration.

* * * * *